US006390628B1

(12) United States Patent
Fujimori et al.

(10) Patent No.: US 6,390,628 B1
(45) Date of Patent: May 21, 2002

(54) IMAGE DISPLAY APPARATUS

(75) Inventors: Motoyuki Fujimori, Suwa; Atsuki Takei, Okaya; Tatsuto Hirabayashi, Akashima-machi, all of (JP)

(73) Assignee: Seiko Epson corportation, Tokyo (JP)

( * ) Notice: Subject to any disclaimer, the term of this patent is extended or adjusted under 35 U.S.C. 154(b) by 0 days.

(21) Appl. No.: 09/379,597

(22) Filed: Aug. 24, 1999

(30) Foreign Application Priority Data

Sep. 2, 1998 (JP) ..... 10-248770
Dec. 15, 1998 (JP) ..... 10-356181

(51) Int. Cl.[7] ..... G03B 21/22; B22D 27/08
(52) U.S. Cl. ..... 353/119; 164/47; 164/71.1
(58) Field of Search ..... 353/30, 31, 119; 362/284; 164/47, 71.1

(56) References Cited

U.S. PATENT DOCUMENTS 3,953,120 A * 4/1976 Badalich et al. ..... 353/119
5,452,032 A * 9/1995 Aosaki et al. ..... 353/119
5,669,688 A * 9/1997 Baar et al. ..... 353/119
5,701,942 A * 12/1997 Adachi et al. ..... 164/71.1
5,820,242 A * 10/1998 Rodriguez et al. ..... 353/119
5,842,761 A * 12/1998 Futakami et al. ..... 353/119
5,855,488 A * 1/1999 Heintz et al. ..... 439/310
5,878,804 A * 3/1999 Williams et al. ..... 164/61
6,142,653 A * 11/2000 Larson ..... 362/653

* cited by examiner

*Primary Examiner*—Russell Adams
*Assistant Examiner*—R. Fuller
(74) *Attorney, Agent, or Firm*—Oliff & Berridge, PLC

(57) ABSTRACT

An image display apparatus including a metal outer housing for which a filling process in a thixotropic forming method has been improved. On a reference surface of an upper housing composing the outer housing of a projection display apparatus, there are formed convex sections, and a supporting rib, the foregoing convex sections extending in the direction where a semimolten metal flows, and the foregoing supporting rib intersecting with the foregoing convex sections. Furthermore, protrusions are formed protruding from the reference surface, and flowing ribs are independently formed on base sections of the protrusions. These convex sections, supporting rib, and flowing ribs are formed in the upper housing for guiding the semimolten metal in the thixotropic forming method, and thereby ensuring filling characteristics of the semimolten metal into individual molds.

23 Claims, 21 Drawing Sheets

IMAGE DISPLAY APPARATUS

BACKGROUND OF THE INVENTION

1. Field of Invention

The present invention relates to an image display apparatus having a metal outer housing. More particularly, the invention relates to an image display apparatus that can be used for a projection display apparatus having a metal outer housing for housing components such as a light source lamp, a modulation device for modulating light emitted from the light source lamp according to image information, and a projection lens for performing zoom-in projection of modulated light onto a projection screen.

2. Description of Related Art

Recent personal computers are small and light. Image display apparatuses for such personal computers, such as displays and projection display apparatuses to be used with such electric equipment, are also required to be proportionally smaller and lighter.

In making such small and light image display apparatuses, considerations described hereinbelow are necessary. A material for an outer housing of the image display apparatus must be one in which the wall thickness of the outer housing can be as small as possible while the strength of the outer housing of which the wall thickness is small must be sufficiently high. Furthermore, in proportion to the size reduction of the image display apparatus, the structural density of components in the apparatus is greater. Therefore, for prevention of heat accumulation, it is preferable that a highly-radiative material be used for the outer housing. Furthermore, since various circuit substrates are included in the image display apparatus, a material applied with an EMI (electromagnetic interference) countermeasure must be used for the outer housing. Furthermore, from the viewpoint of resource-conservation and resource-recycling recently demanded for such electronic apparatuses, the outer housing is preferably formed of a monometallic material that can be easily recycled as a resource, not a material such as a synthetic resin or a metal hybrid material.

Recently, in order to meet the aforementioned requirements for smaller and lighter outer housings, outer housings formed of metal such as a magnesium alloy have been proposed.

As a method for integrally forming such metal outer housings, a thixotropic forming method is known in addition to methods such as casting and forging. In this method, a semimolten metal slurry in both solid and liquid phases is stirred so as to reduce viscosity for carrying out injection-molding.

Compared to a casting method, such as a die-casting method, the thixotropic forming method has more advantages. One of the advantages is that since injection materials can be formed at a lower temperature, less shrinkage occurs due to coolcaking, allowing higher dimensional precision to be obtained. Another advantage is that since surfaces of formed articles are denser, processings such as buffing to be performed after molding, can be simplified.

Nevertheless, the thixotropic forming method still causes problems in injection molding outer housings such as those described above. In the forming process, the semimolten metal slurry is injected at a lower viscosity in a stirred state, its viscosity gradually increases in the mold, causing solidification during filling. Therefore, in this method, filling the semimolten metal slurry into the mold in the shortest possible time is a problem to be solved. Particularly, significant problems arise regarding reduction in filling time for forming a large outer housing and improvement of filling characteristics so as to obtain improved appearance and precision in the formed housing in a case where the molten metal flows at a high speed.

SUMMARY OF THE INVENTION

It is therefore an object of the present invention to provide an image display apparatus having a metal outer housing that will allow improved filling characteristics so that the thixotropic forming method can be performed in shorter time.

To achieve the aforementioned objects, the present invention is characterized in that improvement considerations and ideas are introduced with respect to the structural shape of the outer housing so that the semimolten metal can be filled out in individual molds in the thixotropic forming method in shorter time.

Particularly, according to one aspect of the present invention, there is provided an image display apparatus having an outer housing formed of metal in a thixotropic forming method, in which the outer housing includes a reference surface formed along a direction in which semimolten metal flows in forming processing, and an step surface formed so as to face toward a downstream side of the foregoing semimolten-metal flow direction and so as to intersect with the reference surface, the foregoing step surface comprising a bevel section beveled down at least on a part thereof in the foregoing semimolten-metal flow direction.

In this case, the bevel section may be formed substantially to guide the flow of the semimolten metals, therefore, it may be beveled down along the semimolten-metal flow direction, or it may be beveled down so as to diagonally intersect with the semimolten-metal flow direction. The beveled section may be also formed of a certain slant surface shape or a curved surface shape in which the gradient varies depending on the positions. Furthermore, the bevel section may be formed entirely on the step surface, or it may be formed by bevel-cutting a section where the reference surface and the elevated section intersect each other.

According to such an invention in which the bevel section is formed on the step surface, when the semimolten metal arrives at an intersection of the reference surface and the step surface, it is guided by the bevel section so as to quickly flow through the step surface. This reduces filling time of the semi-molten metal into molds in the thixotropic forming method when forming the outer housing.

According to another aspect of the present invention, there is provided an image display apparatus having an outer housing formed of metal in a thixotropic forming method, in which the outer housing includes a reference surface formed along a direction in which semimolten metal flows in forming processing, the foregoing reference surface having convex sections extending in the direction in which the semimolten metal flows.

According to such an invention, since the convex sections are formed on the reference surface, the semimolten metal quickly flows along the convex sections, allowing time for filling the semimolten metal to individual molds to be reduced. This arrangement is particularly effective for forming a large and thin-wall housing such as an outer housing of a projection display apparatus.

In this case, it is preferable that the reference surface have a supporting rib formed so as to intersect with the convex sections and so as to protrude from the reference surface. In such an arrangement in which the supporting rib intersecting with the convex sections is formed, the semimolten metal flowing on the convex sections diffuses at an intersection with the supporting rib, by which time for filling the semimolten metal can be further reduced.

When the reference surface has openings, it is preferable that the supporting rib be formed along internal peripheries of the openings. In more detail, when a plurality of openings are orderly arranged along the flowing direction, it is preferable that the supporting rib is arranged along borders dividing the openings adjacent to each other.

Since the supporting rib is formed along the internal periphery of the opening of the reference surface, time for filling the semimolten metal into a periphery of the opening can be reduced. In addition, the opening periphery is to be reinforced by the supporting rib after forming, by which the strength of the outer housing can be increased. Such an arrangement is notably advantageous in terms of reduction in filling time of the semimolten metal and reinforcement efficiency by the supporting rib particularly when a plurality of openings is formed in order in the semimolten metal flow direction, as described above.

Furthermore, in such an outer housing, when a peripheral frame is formed so as to surround the reference surface and so as to have a thickness greater than the thickness of the reference surface, the supporting rib is arranged preferably so as to connect with the foregoing peripheral frame.

When the peripheral frame is formed so as to have the wall thickness greater than that of the reference surface of the outer housing, the strength of the outer housing after forming can be greatly increased. Furthermore, in this case, since the peripheral frame and the supporting rib are arranged to connect with each other the semimolten metal can be filled so as to flow therethrough quickly, allowing reduction in filling time and improvement in appearance of the formed housing.

According to another aspect of the present invention, there is provided an image display apparatus having an outer housing formed of metal in a thixotropic forming method, in which the outer housing includes a reference surface formed along a direction in which semimolten metal flows during the forming processing. The protrusions are formed so as to protrude from the reference surface, the protrusions comprising flowing ribs at inflow sides thereof for guiding the semimolten metal thereinto. The protruded flowing ribs may be formed either in a triangular having a straight edge or in a form having a radial edge.

According to such an invention in which protruded flowing ribs are formed on the inflow side of the protrusion, the semimolten metal is allowed to flow quickly into the protruding sections through the flowing ribs, by which filling time can be reduced.

Furthermore, the thickness of a section of the reference surface is preferably 3.0 mm or less, or more preferably 1.5 mm or less.

In a trend in which image display apparatuses are required to be lighter, although the magnesium alloy is used as a material for the outer housing, the weight of the outer housing must be less than that of a synthetic resin outer housing. From this point of view, the thickness of the reference surface of the outer housing must be predetermined to be 3.0 mm or less, preferably 1.5 mm or less, so as to be equal to or less than a specific-gravity ratio of the magnesium alloy and the synthetic resin material (about 0.6 to 0.7). To form a large outer housing having a wall thickness of 3.0 mm or less, flowing and filling time of the semimolten metal are problems. However, use of the present invention allows a significant reduction in filling time, and in addition, enhancement of appearance and precision in the housing formed in the thixotropic forming method by improving the filling characteristics.

According to another aspect of present invention, there is provided an image display apparatus having an outer housing formed of metal in a thixotropic forming method, in which the outer housing includes an upper housing for covering an upper surface of the apparatus, a lower housing for forming the bottom face of the apparatus, side housings arranged between the foregoing two housings for covering side faces of the apparatus, a rear housing for covering a rear face of the apparatus, and a front housing for covering a front face of the apparatus, the foregoing upper housing, lower housing, side housings, rear housing, and front housing being formed as plates and being independently formed.

According to such an invention in which the individual housings such as the upper housing composing the outer housings are formed as plates and are independently formed, the semimolten metal flows smoothly and filling time can be reduced.

According to another aspect of the present invention, there is provided an image display apparatus having an outer housing formed of metal in a thixotropic forming method, in which the outer housing includes an upper housing for covering an upper surface of the apparatus, a lower housing for covering the bottom face of the apparatus, side housings arranged between the foregoing two housings for covering side faces, a rear housing for covering a rear face of the apparatus, and a front housing for covering a front face of the apparatus. In the above, the upper housing and the lower housing are individually formed such that they are bent along edge lines on the side of the side housings by a predetermined width in the directions opposing each other, and the upper housing, the lower housing, the side housings, the rear housing, and the front housing are independently formed.

According to such an invention in which the upper housing and the lower housing are bent by a predetermined width in the directions opposing each other and are nevertheless substantially in the form of a plate, and other housings are arranged individually in the form of a plate and are formed independently, the semimolten metal flows smoothly and filling time can be reduced.

DETAILED DESCRIPTION OF PREFERRED EMBODIMENTS

A first embodiment is described below with reference to the accompanying drawings.

Figure 1:
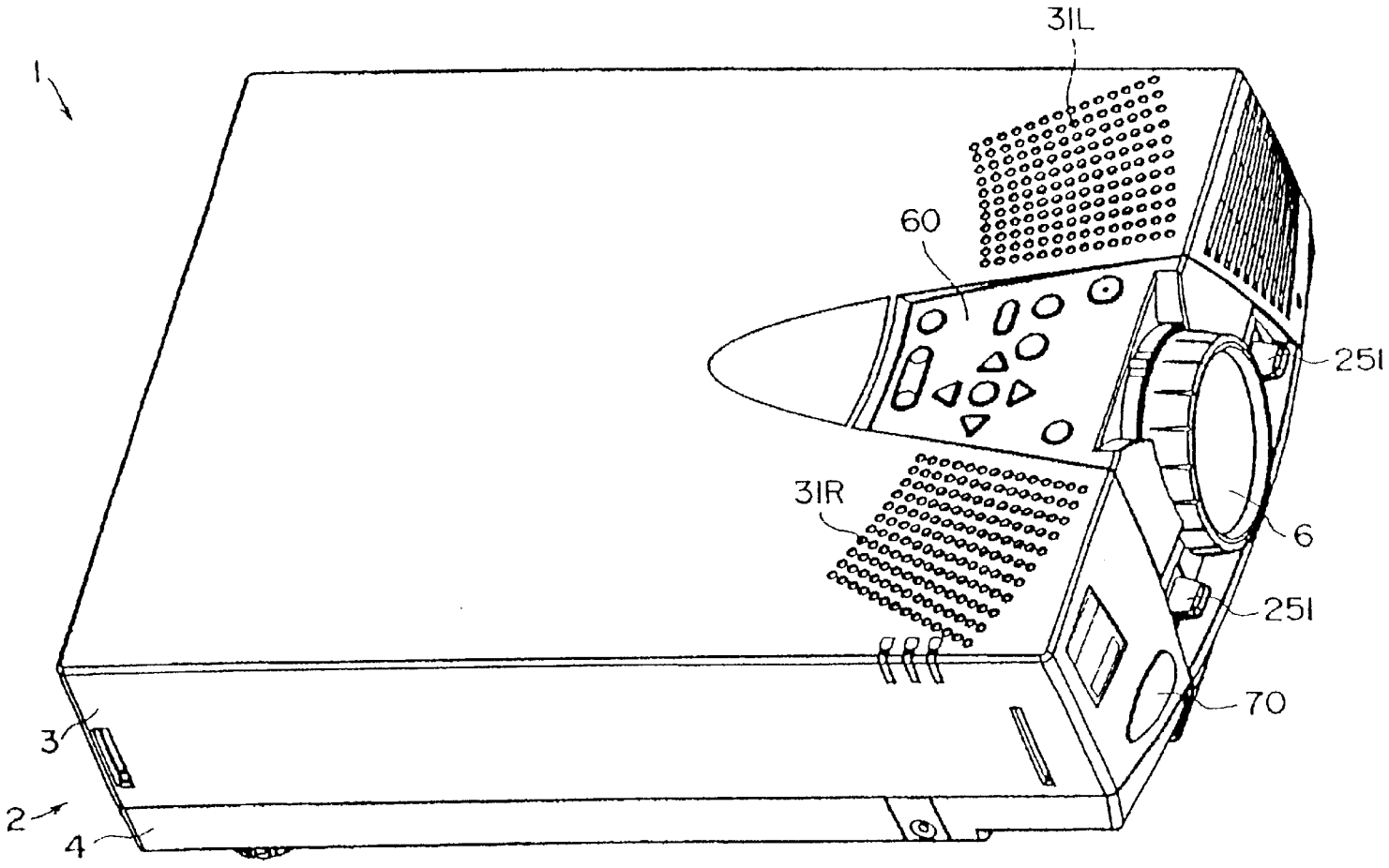
FIG. 1 is an upper-side overall perspective view of a projection display apparatus of a first embodiment according to the present invention.
Figure 2:
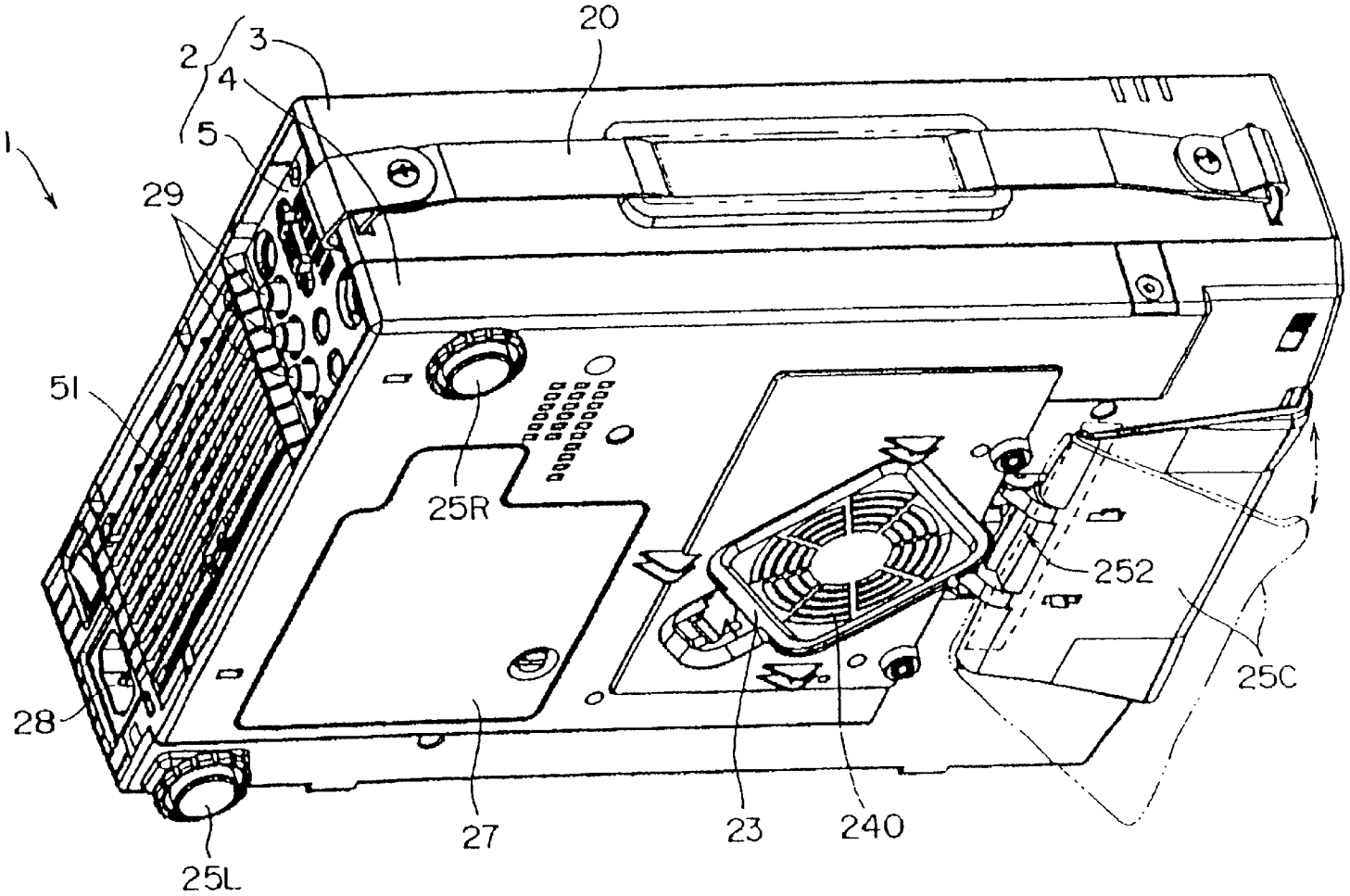
FIG. 2 is a lower-side overall perspective view of the projection display apparatus of the first embodiment according to the present invention.

FIGS. 1 and 2 are an overall perspective view of a projection display apparatus 1, FIG. 1 being an upper perspective view thereof, and FIG. 2 being a lower perspective view thereof.

The projection display apparatus I separates a light output from a light source lamp into primary three color lights of red (R), green (G), and blue (B), modulates these individual color lights through a liquid crystal panel (a modulation system) corresponding to image information, synthesizes the modulated lights through a prism (a color synthesizing optical system), and performs zoom-in display onto a projection screen through a projection lens 6. Except for part of the projection lens 6, individual components are housed in an outer housing 2 of a magnesium alloy. This outer housing 2 is basically formed of an upper housing 3, a lower housing 4, and a rear housing 5; the upper housing 3 having a removable handle 20 on a side face thereof (shown in FIG. 2).

A plurality of communication holes 31L and 31R are provided at front left and right sides of an upper face of the upper housing 3. Between the sets of the communication holes 31L and 31R, there are arranged operation switches 60 for adjustment of image quality, focus, and the like regarding display to be provided by the projection display apparatus 1. Furthermore, at a left lower portion toward the front of the upper housing 3, there is arranged a light receiving portion 70 for receiving optical signals from a remote controller (not shown in the drawings).

As shown in FIG. 2, on a bottom face of the lower housing 4, there are arranged a lamp-replacement cover 27 to be used for changing a light source lamp unit 8 (to be described later) stored therein, and an air filter cover 23 formed with an air intake 240 for cooling the inside of the apparatus.

Furthermore, as shown in FIG. 2, on the bottom face of the lower housing 4, a foot 25C is arranged substantially in the center of a front end of the bottom face, and a foot 25R and a foot 25L are respectively arranged at right and left corners of the rear end. For reference, by pushing a lever 251 shown in FIG. 1 upward, the foot 25C is rotationally-operated by a rotation mechanism 252 (in FIG. 2) at a rear side, and the foot 25C is urged to move apart from the apparatus body so as to be open, as shown by a two-dotted chain line in FIG. 2. Adjustment of the rotation velocity allows a change in the upward and downward position of display images on the projection screen. On the other hand, the foot 25R and the foot 25L are individually constructed such that they can be rotated to move forward or backward in the protruding direction, in which adjustment of the forward or backward movement pitch allows changing of a positional angle of a lower portion of a display.

As shown in FIG. 2, in the rear housing 5, there are arranged components such as an AC inlet 28 for an external power supply and various input/output terminals 29; and exhaust 51 for exhausting air in the inside of the apparatus is formed adjacent to the input/output terminals 29.

Figure 3:
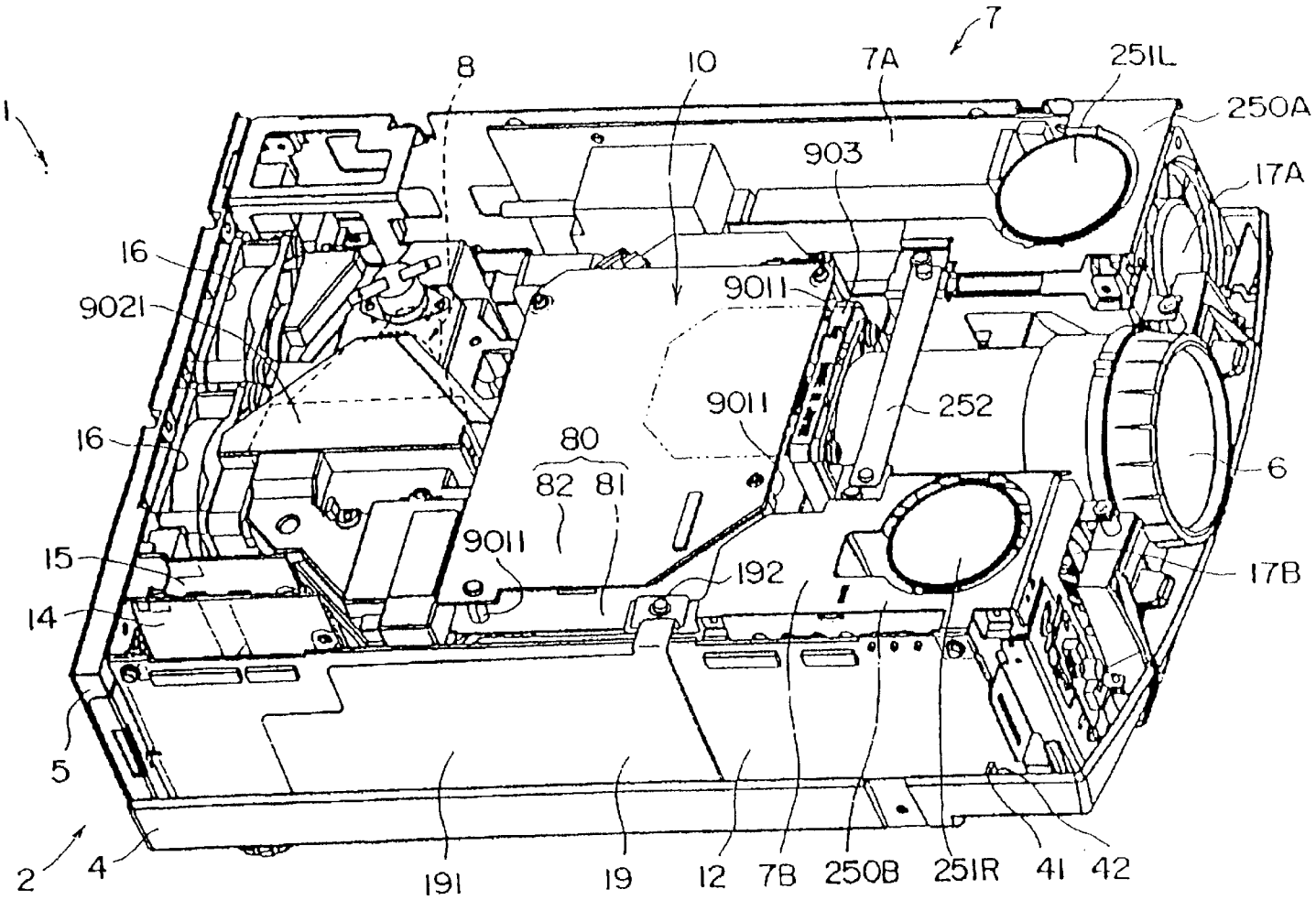
FIG. 3 is a perspective view showing an internal structure of the projection display apparatus according to the first embodiment.
Figure 4:
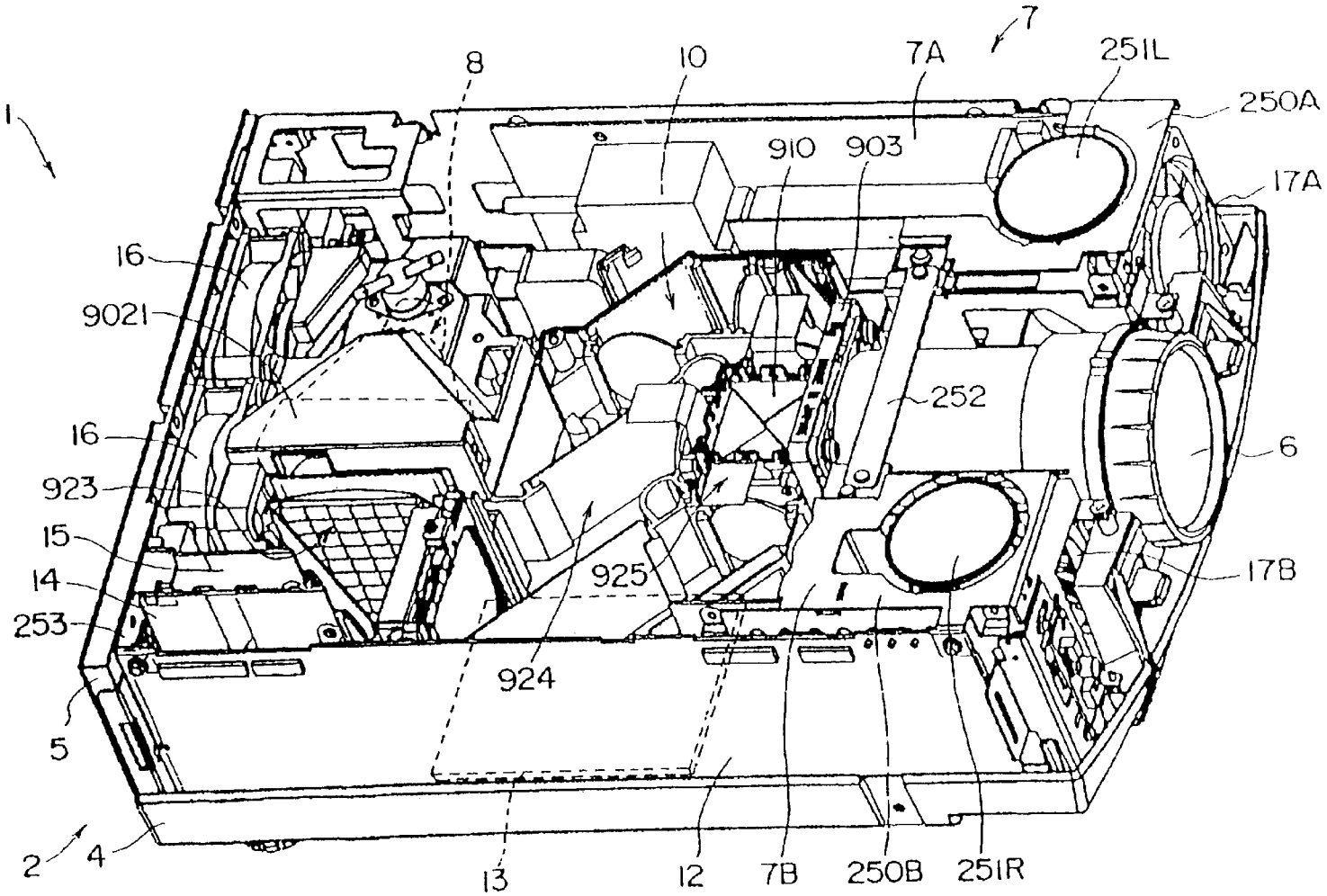
FIG. 4 is a perspective view showing an optical system in the projection display apparatus according to the first embodiment.
Figure 5:
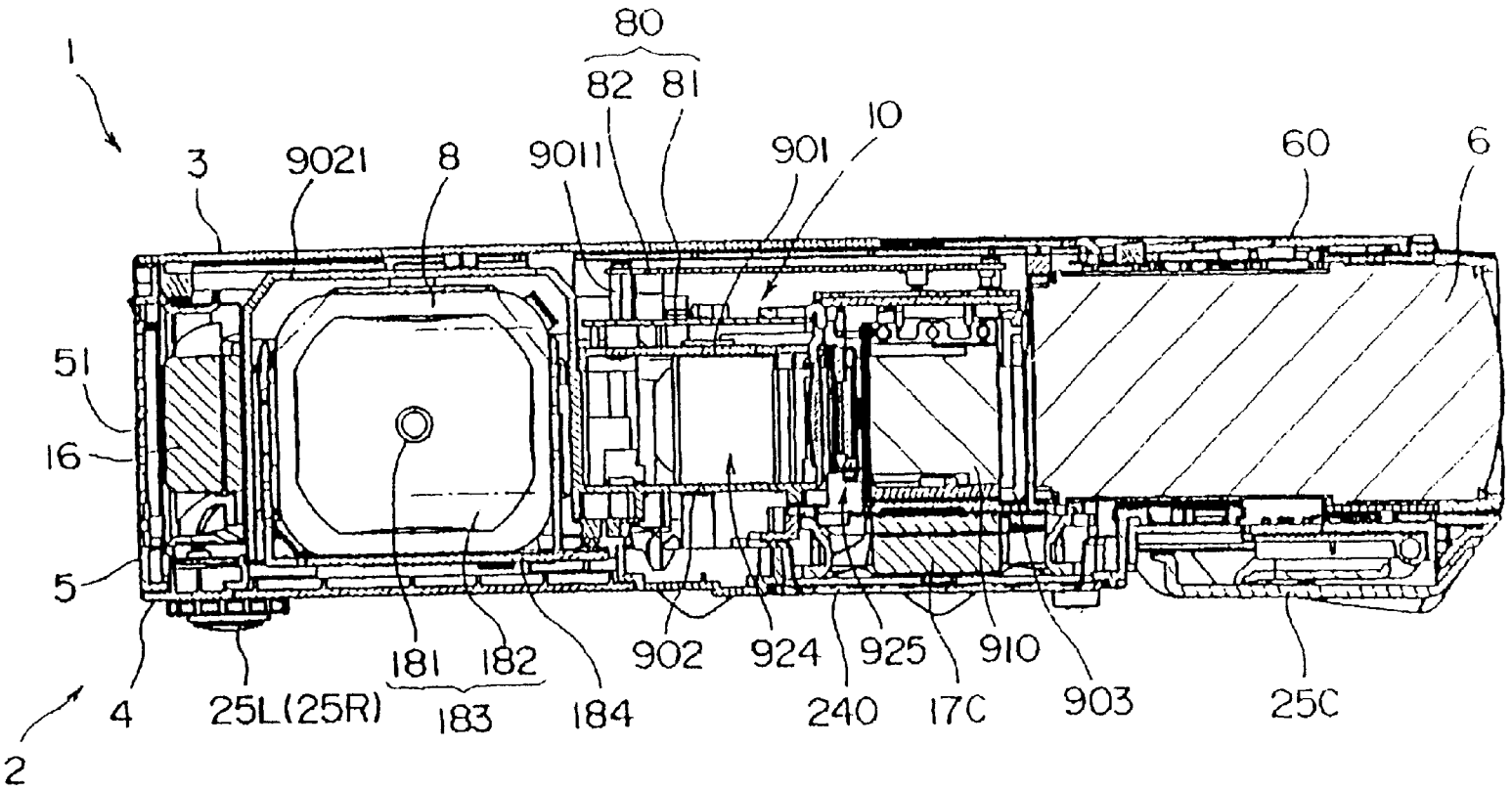
FIG. 5 is a vertical cross-sectional view showing an internal structure of the projection display apparatus according to the first embodiment.

FIGS. 3 to 5 individually illustrate an Internal structure of the projection display apparatus 1. FIGS. 3 and 5 individually show overall perspective views of the Internal structure of the projection display apparatus 1, and FIG. 5 is a vertical cross-sectional view thereof.

As shown in these figures, in the inside of the outer housing 2, there are arranged components such as a power supply unit 7, a light source lamp unit 8, an optical unit 10 composing an optical system, a driver board 80 functioning as an optical-modulation device drive means formed of two circuit substrates, and a main board 12.

The power supply unit 7 is constituted of a first power supply block 7A and a second power supply block 7B which are arranged at each side of the projection lens 6. The first power supply block 7A includes components such as a transformer, a rectifier circuit, a smoothing circuit, and a voltage-stabilizing circuit to transform power fed through the AC inlet 28 so as to feed the transformed power to mainly the second power supply block 7B and the light source lamp unit 8. The second power supply block 7B includes a transformer and various circuits in a manner similar to the components of the first power supply block 7A to further transform the power fed from the first power supply block 7A. The transformed power is fed to a power supply circuit substrate 13 (indicated by dotted lines in FIG. 4) arranged below the optical unit 10 and to a first air-intake fan 17A and a second air-intake fan 17B which are arranged adjacent to the respective first power supply block 7A and the second power supply block 7B. The power supply circuit substrate 13 has thereon a power supply circuit for processing the power fed from the second power supply block 7B that creates driving power for a control circuit on the main board 12, and in addition, power for other low-power components. The second air-intake fan 17B is arranged between the second power supply block 7B and the projection lens 6 so as to take cooling air from the outside to the inside through a gap formed between the upper housing 3 (in FIG. 1) and the projection lens 6. The respective power supply blocks 7A and 7B have a cover member 250A and a cover member 250B. The respective cover members 250A and 250B have sound-output speakers 251L and 251R in positions corresponding to the communication holes 31L and 31R.

The light source lamp unit 8, which composes a light source section of the projection display apparatus 1, includes a light source device 183 comprised of a light source lamp 181 and a reflector 182. It also includes a lamp housing 184 to accommodate the foregoing light source unit 183. The light source lamp unit 8 is housed in a housing 9021 integrally formed to include a lower light guide 902 (in FIG. 5) and is arranged so as to be removable from the lamp-replacement cover 27. At a rear side of the housing 9021, there are arranged a pair of exhaust fans 16 in parallel to each other in positions corresponding to the exhaust 51 of the rear housing 5. Cooling air taken through the first and second air-intake fans 17A and 17B and a third air-intake fan 17C is introduced by the foregoing exhaust fans 16 to the inside through openings arranged in the vicinity of the housing 9021. Then, the cooling air is used to cool the light source lamp unit 8 and is exhausted through the exhaust 51. For reference, power for the individual exhaust fans 16 is fed from the power supply circuit substrate 13.

The optical unit 10 includes an illumination optical system 923, a color separation optical system 924, a modulation system 925, and a prism unit 910 as a color synthesizing optical system to optically process lights output from the light source lamp unit 8 to form an optical image corresponding to image information. Optical elements of the optical unit 10, which are other than the modulation system 925 and the prism unit 910, are arranged such that they are sandwiched and supported between upper and lower light guides 901 and 902. These upper light guide 901 and lower light guide 902 are coupled and fixed with screws to a side of the lower housing 4. These light guides 901 and 902 are also fixed with screws to a side of prism unit 910.

Figure 6:
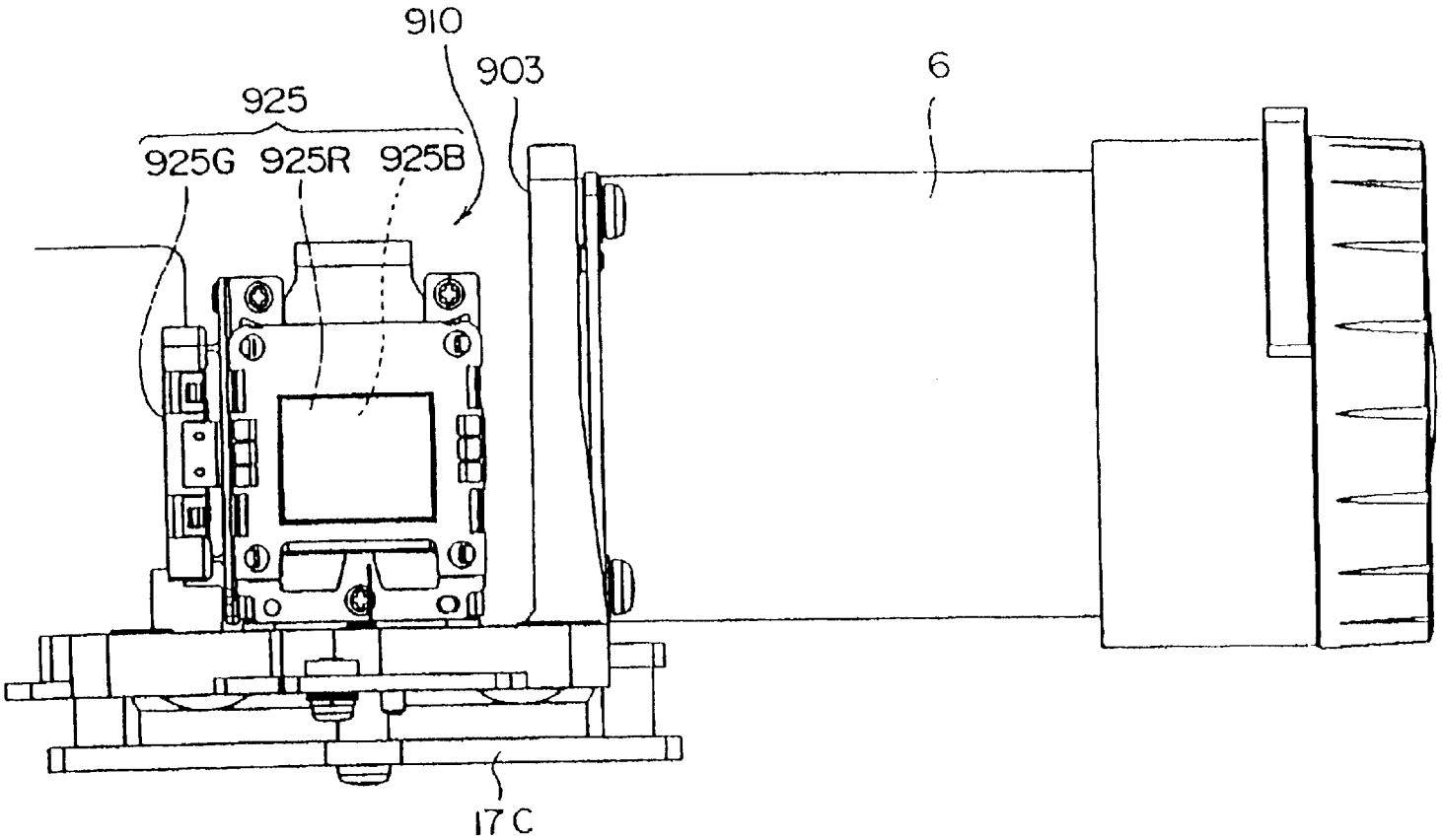
FIG. 6 is a vertical cross-sectional view showing a head body mounting thereon a modulation device, a color synthesizing optical system, and a projection lens according to the first embodiment.

As is also shown in FIG. 6, the prism unit 910 in a rectangular-parallelepiped shape is fixed with screws at a reverse side of a head body 903 which is an integrally formed structure of magnesium which side faces are substantially L-shaped. Individual liquid crystal panels 925R, 925G, and 925B which compose the modulation system 925 are arranged to oppose three side faces of the prism unit 910 and are fixed with screws to the prism unit 910 through a plate member. For reference, the liquid crystal panel 925B is arranged in a position opposing the liquid crystal panel 925R with the prism unit 910 sandwiched therebetween (FIG. 7), which is shown in FIG. 6 only with a leader line (a dotted line) and reference numerals. These liquid crystal panels 925R, 925G, and 925B are positioned below the head body 903 and are cooled by cooling air flowing from the third air-intake fan 17C arranged to oppose the air intake 240. At this time, power for the third air-intake fan 17C is fed from the power supply circuit substrate 13 through the driver board 80. Furthermore, a base end side of the projection lens 6 is fixed with screws to the front face of the head body 903. In this way, as shown in FIG. 5, the head body 903 having thereon the prism unit 910, the modulation system 925, and the projection lens 6 is fixed with screws to the lower housing 4.

The driver board 80 drives and controls the foregoing respective liquid crystal panels 925R, 925G, and 925B of the modulation system 925, and it is formed of a separate setting substrate 81 and a common setting substrate 82, which will be further described later. The separate setting substrate 81 and the common setting substrate 82 are individually overlaid on upper portions of the optical unit 10. The separate setting substrate 81 positioned below and the common setting substrate 82 are arranged apart with stud bolts 9011 therebetween, and on their surfaces opposing each other, there is mounted a plurality of circuit elements (not shown) for forming a control circuit. For reference, although the figures omit such description, the separate setting substrate 81 and the common setting substrate 82 are electrically connected through connectors arranged in positions of their surfaces opposing each other.

Cooling air taken through the third air-intake fan 17C described earlier is allowed to cool the liquid crystal panels 925R, 925G, and 925B, and it is then fed to a space between the separate setting substrate 81 and the common setting substrate 82 to cool the circuit elements on the individual substrates 81 and 82.

The main board 12 has a control circuit formed thereon to entirely control the projection display apparatus 1, and it is vertically arranged along lateral sides of the optical unit 10. The main board 12 is electrically connected to the driver board 80, the operation switches 60, and an interface substrate 14 and a video substrate 15 which have the input/output terminals 29. It is further electrically connected to the power supply circuit substrate 13 through a connector or the like so that the control circuit of the main board 12 is driven by power created by the power source circuit on the power supply circuit substrate 13, that is, power from the second power supply block 7B. For reference, the main board 12 is cooled by cooling air fed therein through the second air-intake fan 17B and the second power supply block 7B.

In FIG. 3, a guard member 19 made of metal such as aluminum is arranged between the main board 12 and the outer housing 2 (only the lower housing 4 and the rear housing 5 are shown in FIG. 3). This guard member 19 has a large surface section 191 extending to the upper and lower ends of the main board 12, an upper portion thereof being fixed with a screw 192 to the cover member 250B of the second power supply block 7B, and the lower end being engaged, for example, to a slit of the lower housing 4. As a result of the above, when the upper housing 3 is fitted to the lower housing 4, interference by the upper housing 3 (FIG. 1) to the main board 12 is avoided, and in addition, the main board 12 is protected from external noise.

Figure 7:
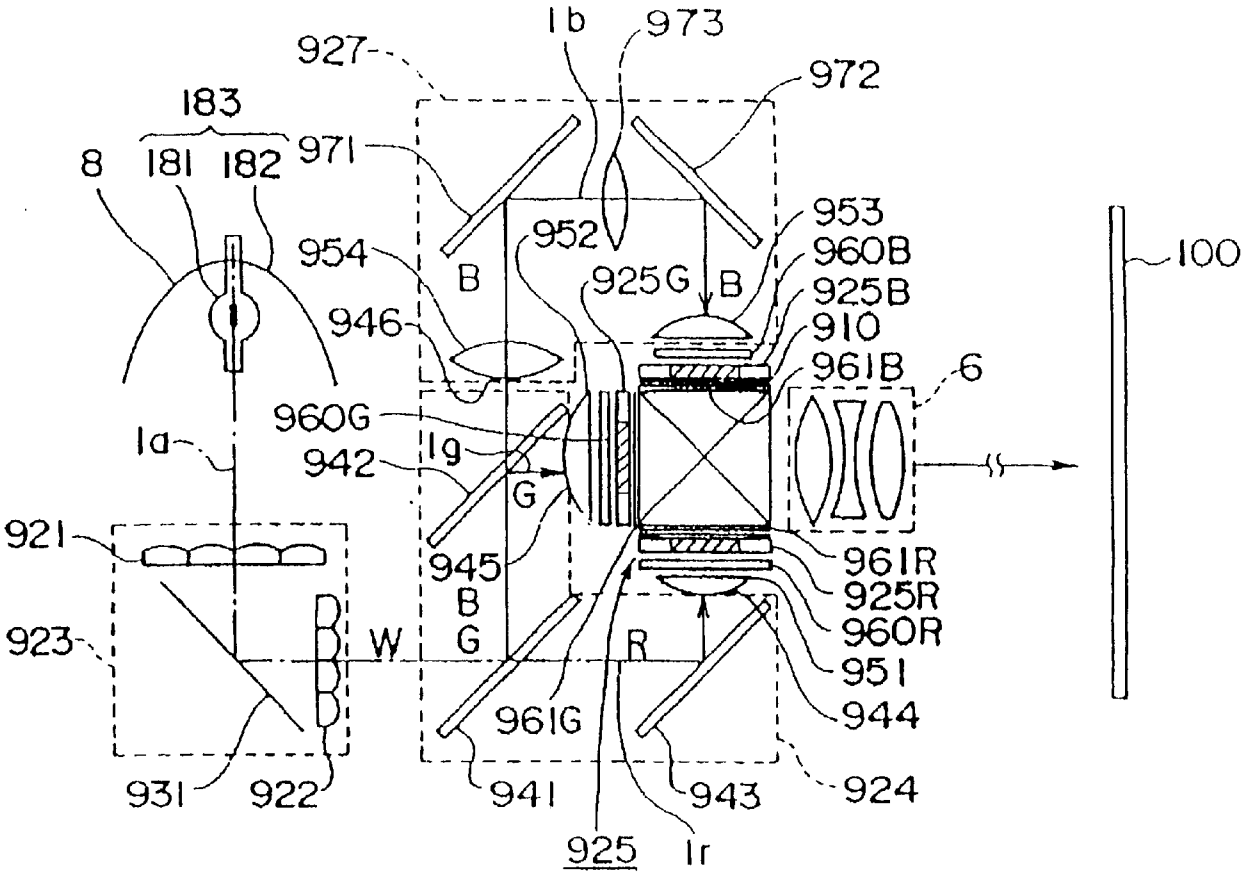
FIG. 7 is a schematic drawing of an internal structure of the optical system of the projection display apparatus according to the first embodiment.

Referring to a schematic drawing in FIG. 7, a description will be given below of the optical system, that is, the optical unit 10 of the projection display apparatus 1.

As has been already described, the optical unit 10 includes the illumination optical system 923, the color separation optical system 924, the modulation system 925, and the prism unit 910. The illumination optical system 923 averages an in-plane illumination distribution of a light (W) from the light source lamp unit 8. The color separation optical system 924 separates the light(W) output from the illumination optical system 923 into lights of red (R), green (G), and blue (B). The modulation system 925 modulates the individual color lights R, G, and B according to image information. The prism unit 910 is a color synthesizing optical system that synthesizes the individual color lights after modulation.

The illumination optical system 923 includes a reflecting mirror 931 that folds an optical axis 1*a* of the light (W) output from the light source lamp unit 8 toward a front of the apparatus. It also includes a first lens plate 921 and a second lens plate 922 which are arranged in the positions sandwiching the reflecting mirror 931.

The first lens plate 921 includes a plurality of rectangular lenses arranged in a matrix form to separate a light output from a light source into a plurality of partial lights and to condense the individual partial lights in the vicinity of the second lens plate 922.

The second lens plate 922 includes a plurality of rectangular lenses arranged in a matrix to overlay individual partial lights output from the first lens plate 921 on the liquid crystal panels 925R, 925G, and 925B (to be described later), which compose the modulation system 925.

In this way, in the projection display apparatus 1 of the embodiment, since the illumination optical system 923 illuminates the liquid crystal panels 925R, 925G, and 925B at substantially averaged illumination, projection images without irregular illumination can be obtained.

The color separation optical system 924 is constituted of a blue-green reflecting dichroic mirror 941, a green reflecting dichroic mirror 942, and a reflecting mirror 943. First, in the blue-green reflecting dichroic mirror 941, the blue light B and the green light G included in the light W, which is output from the illumination optical system 923, are reflected at right angles and are allowed to travel toward the green reflecting dichroic mirror 942.

The red light R travels through the blue-green reflecting dichroic mirror 941, is reflected by the reflecting mirror 943 at right angles, and is output from an output section 944 for the red light R to the prism unit 910. Next, although the blue light B and the green light G have been reflected by the blue-green reflecting dichroic mirror 941, only the green light G is reflected by the green reflecting dichroic mirror 942 at right angles and output from an output section 945 for the green light G to the prism unit 910. The blue light B traveling through the green reflecting dichroic mirror 942 is output from an output section 946 for the blue light B to a relay optical system 927. In this embodiment, distances from an output section of the illumination optical system 923 for the light W to the individual output sections 944, 945, and 946 for the lights R, B, and G of the color separation optical system 924 are predefined so as to be the same.

In the respective output sections 944 and 945 of the color separation optical system 924 for the red and green lights R and G, condenser lenses 951 and 952 are arranged. Therefore, the red and green lights R and G output from the individual output sections are input to the condenser lenses 951 and 952 so as to be collimated.

The collimated individual green and red lights R and G thus travel through input-side polarizers 960R and 960G and are input to the liquid crystal panels 925R and 925G where they are modulated and they are combined with image information corresponding to the individual color lights. That is, these liquid crystal panels 925R and 925G are switching-controlled according to the image information, by which the individual color lights traveling therethrough are modulated. On the other hand, the blue light B is guided to the corresponding liquid crystal panel 925B through the relay optical system 927 and is modulated therein in a manner similar to the above. For reference, as the liquid crystal panels 925R, 925G, and 925B of this embodiment, for example, liquid crystal panels using polysilicon TFTs as switching elements may be employed.

The relay optical system 927 includes a condenser lens 954, an input-side reflecting mirror 971, an output-side reflecting mirror 972 which are arranged at the output side of the output section 946 for the blue light B, an intermediate lens 973 arranged between the foregoing reflecting mirrors, and a condenser lens 953 arranged in front of the liquid crystal panel 925B. In this arrangement, the blue light B output from the condenser lens 953 is allowed to travel through an input-side polarizer 960B, is input to the liquid crystal panel 925B, and is therein modulated. At this time, the optical axis 1*a* of the light W and optical axes 1*r*, 1*g*, and 1*b* of the respective lights R, G, and B are formed in the same surface. Regarding optical path lengths of the individual color lights, that is, distances from the light source lamp 181 to the individual liquid crystal panels, the blue light B is the longest. Therefore, lightquantity loss is greatest in this case. However, this loss can be minimized by inclusion of the relay optical system 927.

The individual color lights R, G, and B which have traveled through the individual liquid crystal panels 925R, 925G, and 925B and modulated therein travel through output-side polarizers 961R, 961G, and 961B, are input to the prism unit 910, and they are synthesized thereat. As a result of the synthesis by the prism unit 910, a color image is zoomed-in and projected through the projection lens 6 onto a projection screen 100 placed in a predetermined position.

Figure 8:
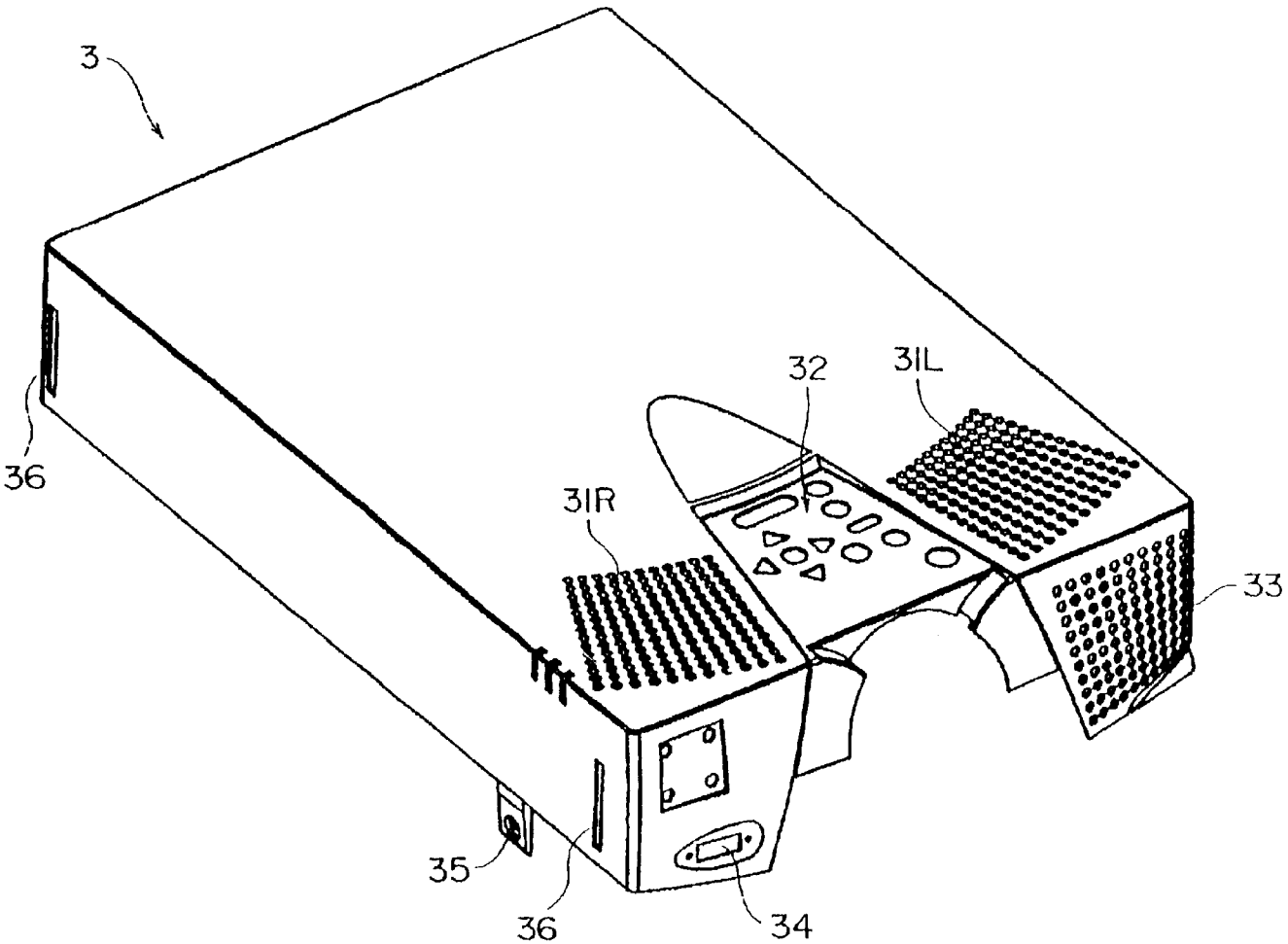
FIG. 8 is an overall perspective view of an upper housing of the projection display apparatus according to the first embodiment.
Figure 9:
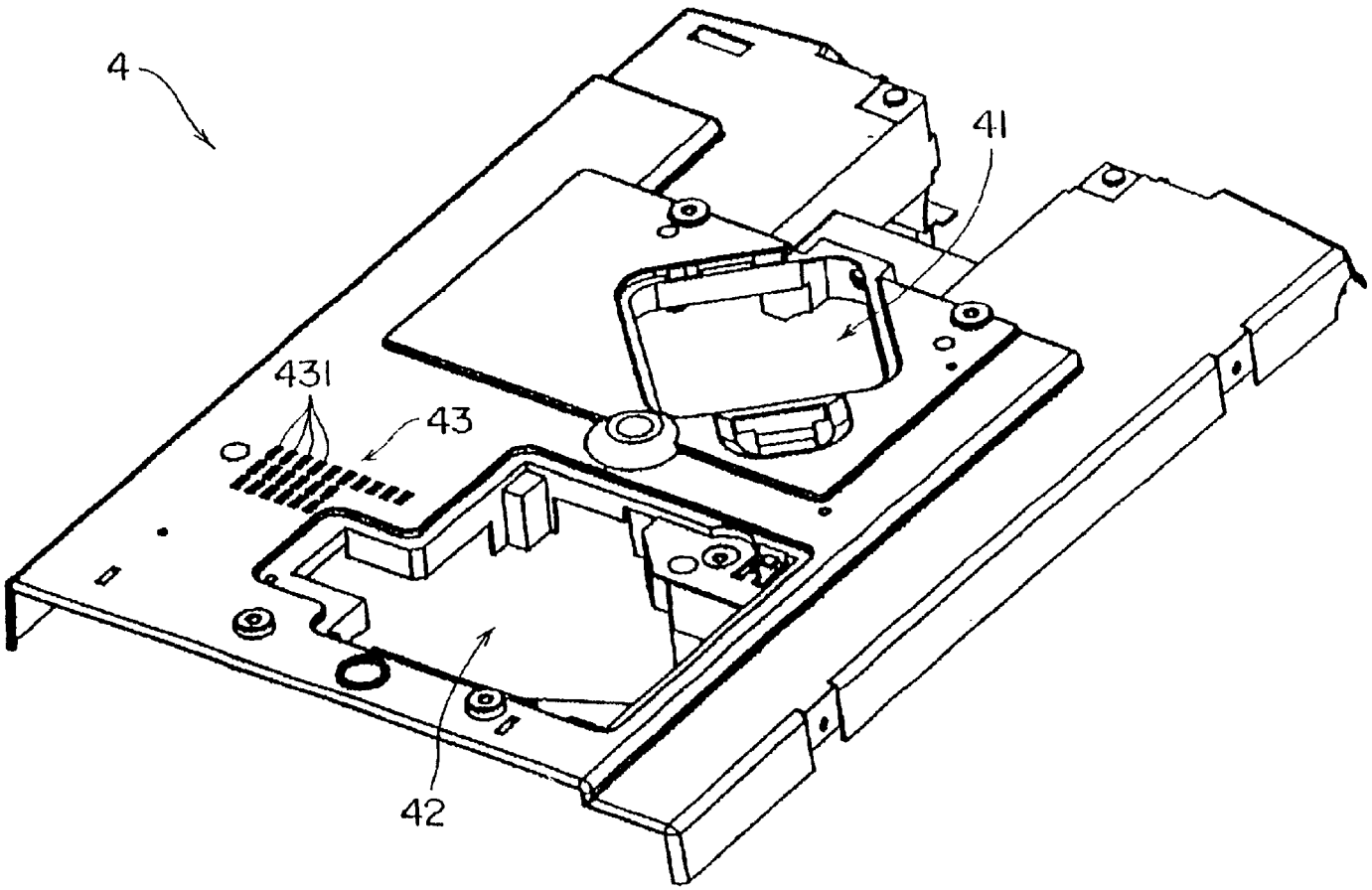
FIG. 9 is an overall perspective view of a lower housing of the projection display apparatus according to the first embodiment.
Figure 10:
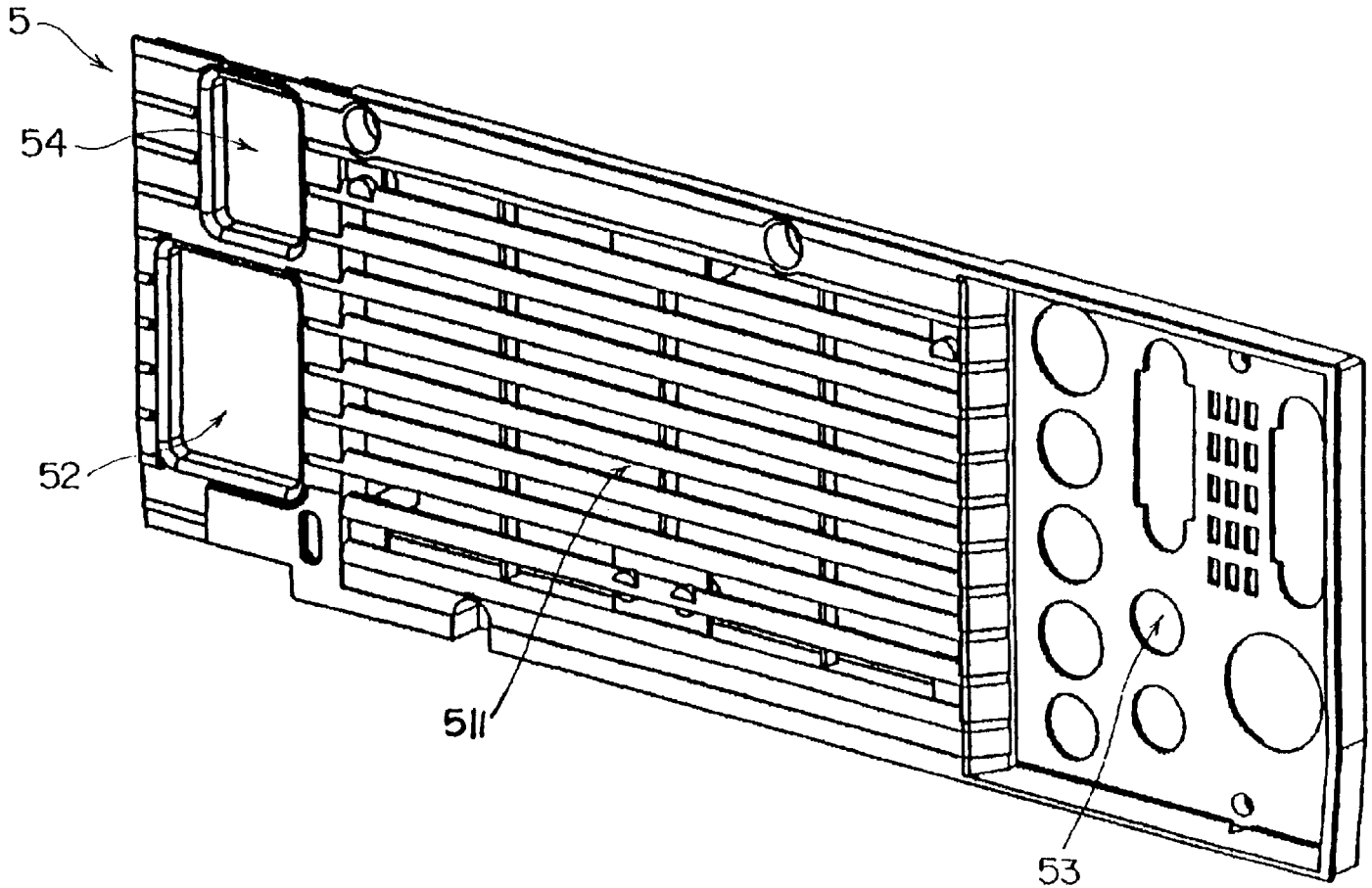
FIG. 10 is an overall perspective view of a rear housing of the projection display apparatus according to the first embodiment.

As shown in FIGS. 8 to 10, the outer housing 2 for housing therein components of the aforementioned projection display apparatus 1 is composed of the upper housing 3 for covering upper portions of the apparatus, the lower housing 4 forming the bottom of the apparatus, and the rear housing 5 for covering rear portions of the apparatus. As shown in FIG. 8, on the upper face of the upper housing 3, there are arranged a plurality of the communication holes 31R and 31L at the front left and right sides, and a plurality of switch button openings 32 for operation switches 60 between the communication holes 31R and 31L. Furthermore, substantially in the center of a front face of the upper housing 3, a cutout is made for inserting the projection lens 6. Front end portions of the upper housing 3 include communication holes 33 for introducing cooling air, and a photoreceptor installation hole 34 for installation of a photoreceptor. On a side face of the upper housing 3, there are formed protrusions 35 in lower end portions for fixing the lower housing 4, and grooved openings 36 for receiving the handle 20.

As shown in FIG. 9, a rectangular cover-installation opening 41 for installation of an air-filter cover 23 is formed substantially in the center of front portions of the lower housing 4. Furthermore, in a rear portion of the lower housing 4, there is formed a lamp-removing/fitting opening 42 for replacement of the light source lamp unit 8; and to the lamp-removing/fitting opening 42, the lamp-replacement cover 27 described earlier is fitted. Furthermore, at a side of this lamp-removing/fitting opening 42, there is formed an air-intake 43 comprised of a plurality of long openings 431 arranged in order in the direction from the rear to the front of the lower housing 4 in order to cool the light source lamp unit 8.

As shown in FIG. 10, the rear housing 5 includes a section for exhausting air in the inside of the apparatus, such as the AC inlet 28, and the input/output terminals 29. Substantially in the center of the rear housing 5, there is formed the exhaust 51 consisting of a plurality of grooved openings 511; and at sides thereof, there are formed an AC inlet connection opening 52, an input/output-terminal connection opening 53, and an opening 54 for allowing power-switch operation.

The upper housing 3, lower housing 4, and a rear housing 5 as described above are formed in a thixotropic forming method that performs injection-molding of a semimolten metal slurry of a magnesium alloy. In this case, a reference wall thickness of the housing ranges from 1.0 mm to 1.5 mm.

In the thixotropic forming method, it is known that generally, a time period for filling the semimolten metal, that is, the flow length (L) of the semimolten metal, is proportionally related to the wall thickness (T), hence, the smaller the wall thickness, the shorter the flow length. That is, for evaluation of forming efficiency in the thixotropic forming method, only evaluation of the flow-length/wall-thickness (L/T) is sufficient. Therefore, increasing the L/T value is the key to efficient production of the upper housing 3, the lower housing 4, and the rear housing 5.

Such being the case, various considerations are implemented with respect to shapes of internal faces of the upper housing 3, the lower housing 4, and the rear housing 5 in order to reduce the time for filling the semimolten metal slurry.

Figure 11:
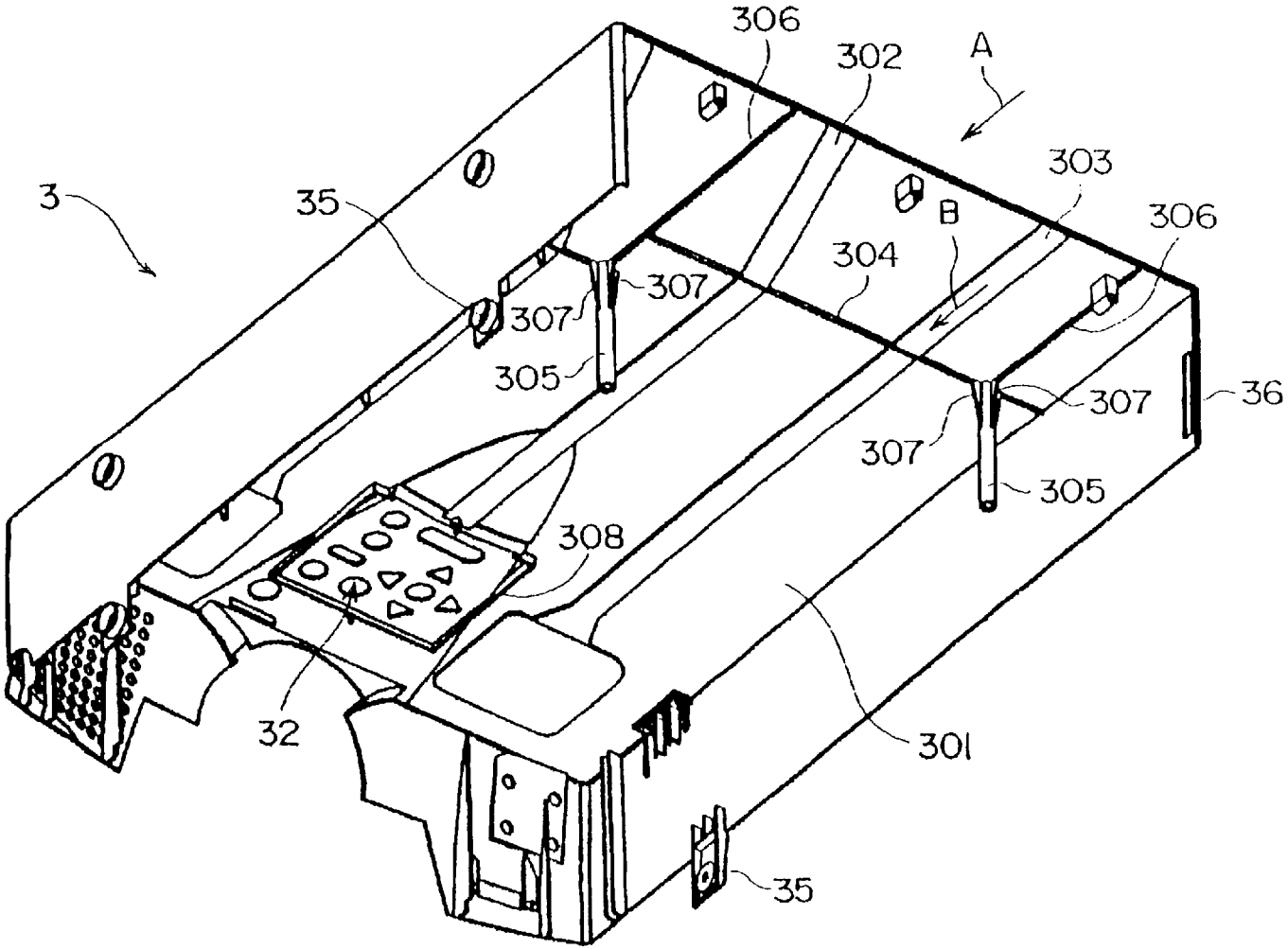
FIG. 11 is an overall perspective view showing an internal structure of the upper housing of the projection display apparatus according to the first embodiment.

As shown in FIG. 11, in the inside of the upper housing 3, there is a reference surface 301 normally having a thickness of 1.0 mm to 1.5 mm. Substantially in the center of the foregoing reference surface 301, there are formed two convex sections 302 and 303 extending from the rear end to the front of the apparatus, and a supporting rib 304 protruding from the reference surface 301 and intersecting with the convex sections 302 and 303. Furthermore, in the inside of the upper housing 3, there are formed protrusions 305 protruding from the reference surface 301, which are to be used for fixing the upper housing 3 and the lower housing 4 with screws. On the protrusions 305, ribs 306 extending from the rear end of the apparatus abut, and there are formed flowing ribs 307 each extending in the direction of the rear end of the apparatus and in the direction perpendicular to the foregoing direction. The flowing rib 307 is formed in a triangle with a side extending in the protruding direction of the protrusions 305 and a side extending in the extending direction of the reference surface 301. Furthermore, a supporting rib 308 is formed such as that it surrounds the switch button openings 32.

Figure 12:
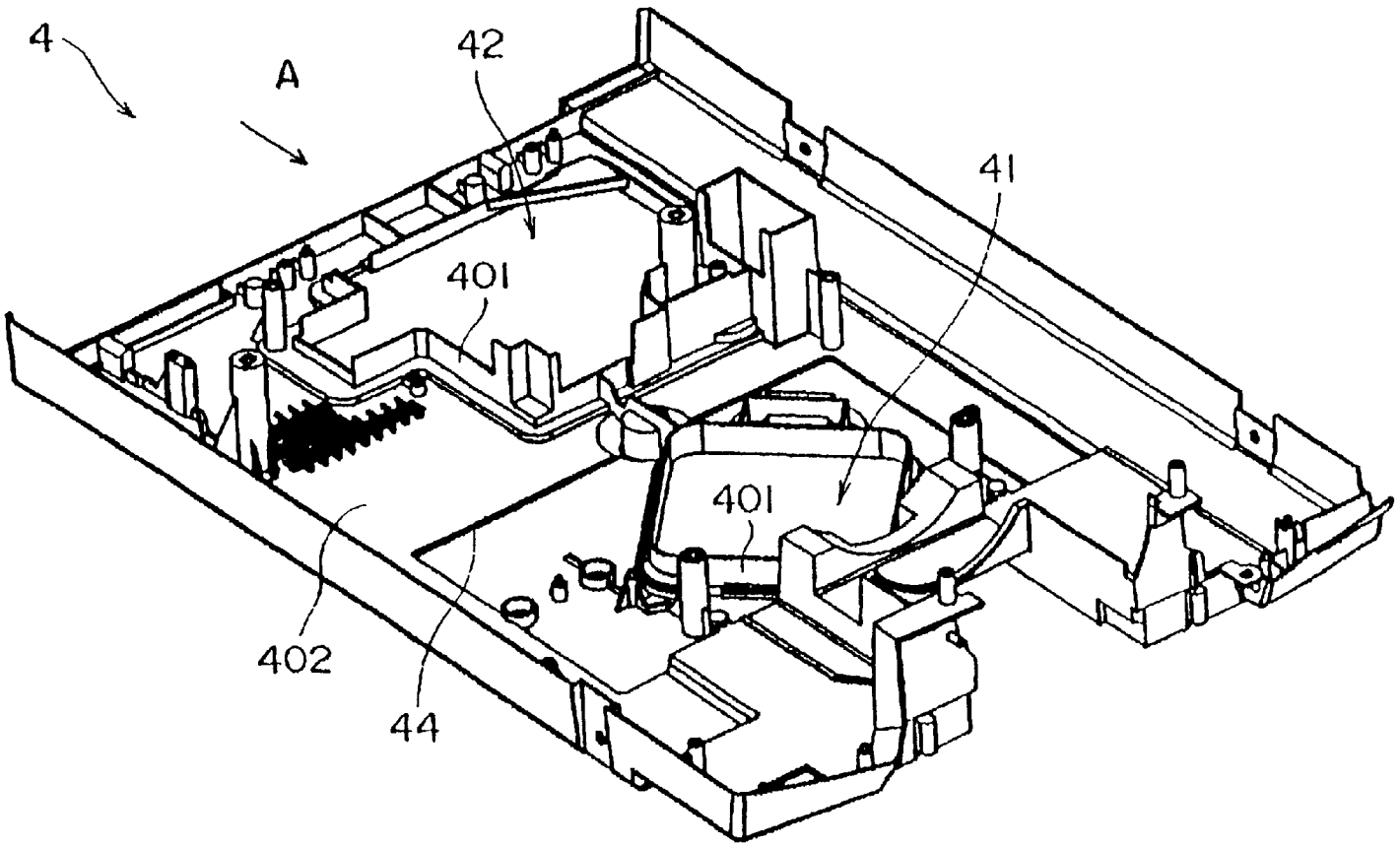
FIG. 12 is an overall perspective view showing an internal structure of the lower housing of the projection display apparatus according to the first embodiment.
Figure 13:
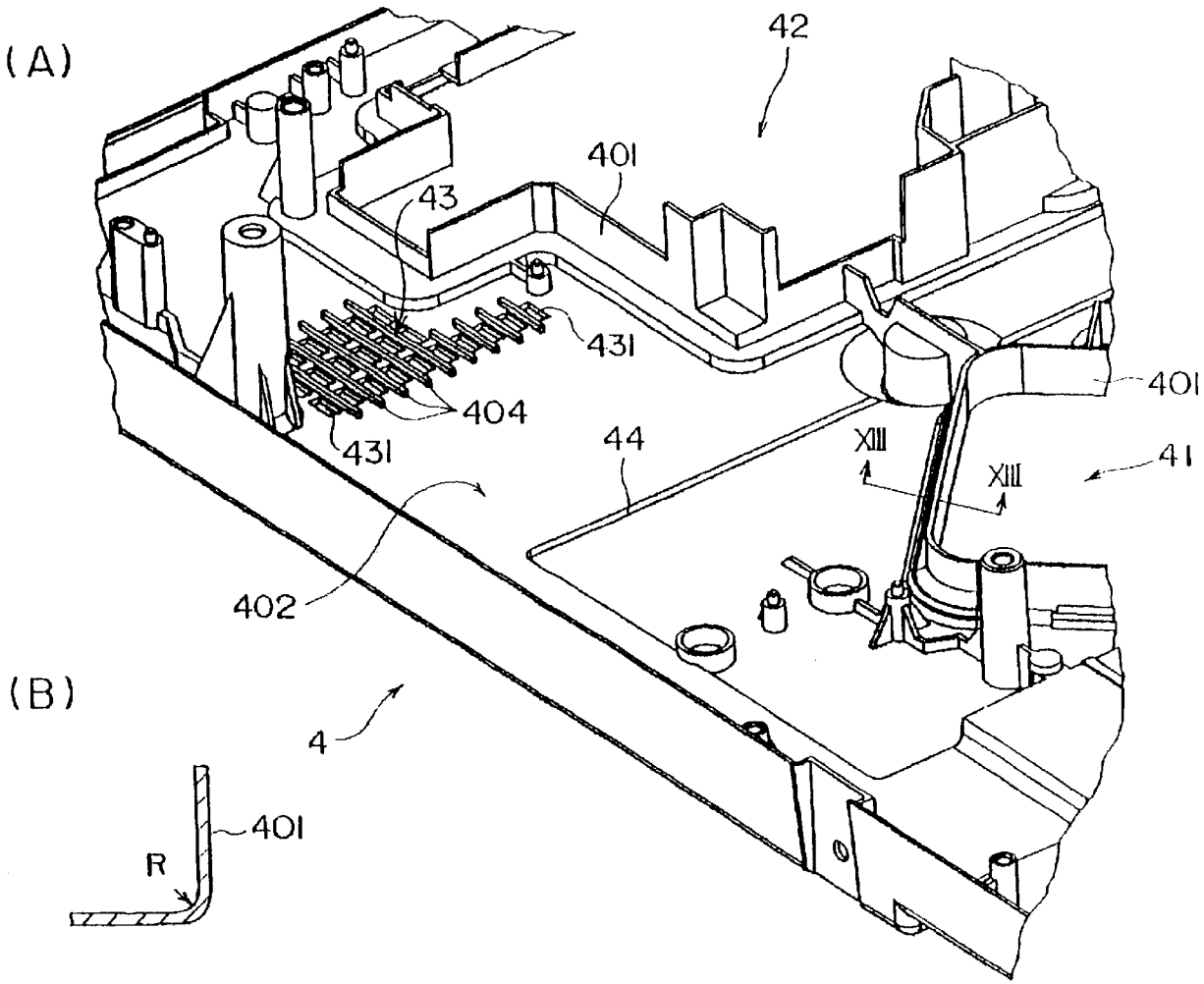
FIG. 13(A) is an overall perspective view showing the internal structure of the lower housing of the projection display apparatus according to the first embodiment.
FIG. 13(B) is a vertical cross-sectional view showing a structure of an step section of the lower housing of the projection display apparatus according to the first embodiment.
Figure 14:
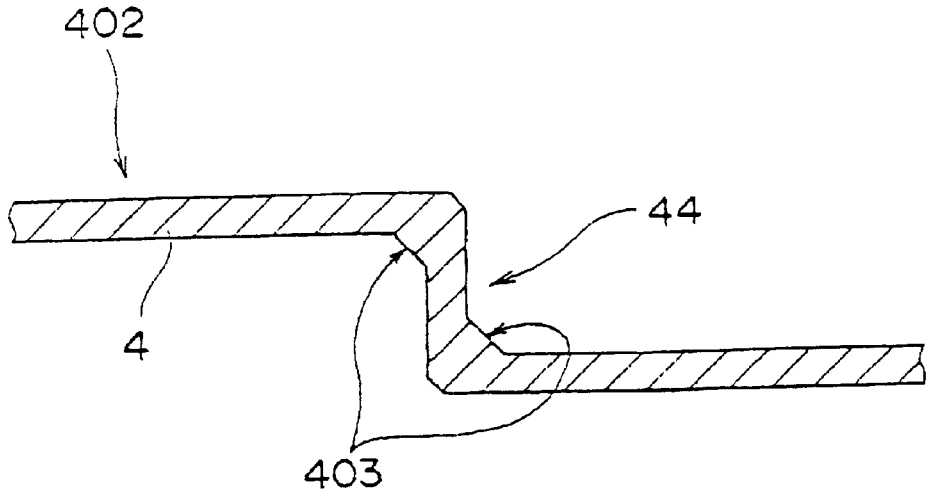
FIG. 14 is a vertical cross-sectional view showing a structure of an step section of the lower housing of the projection display apparatus according to the first embodiment.

As shown in FIGS. 12, 13(A), and 13(B), in the inside of the lower housing 4, ribs 401 are formed such that they individually surround the cover-installation opening 41 and the lamp-removing/fitting opening 42. At root sections of flowing sides of the ribs 401, faces of corners R each equal to or less than 1R are formed, as shown in FIG. 13(B). A portion where the cover-installation opening 41 is formed one-step lower than other portions with an step surface 44 at the border to allow placement of the prism unit 910, the head body 903, and the like. As shown in FIG. 14, a bevel section 403 is formed at the step surface 44 by cutting an intersection of a reference surface 402 and the step surface 44 of the lower housing 4. For reference, not only the step surface 44, but all height-differential sections formed in the outer housing 2 are beveled by more than IR. Furthermore, ribs 404 are formed at borders dividing the individual long openings 431.

Figure 15:
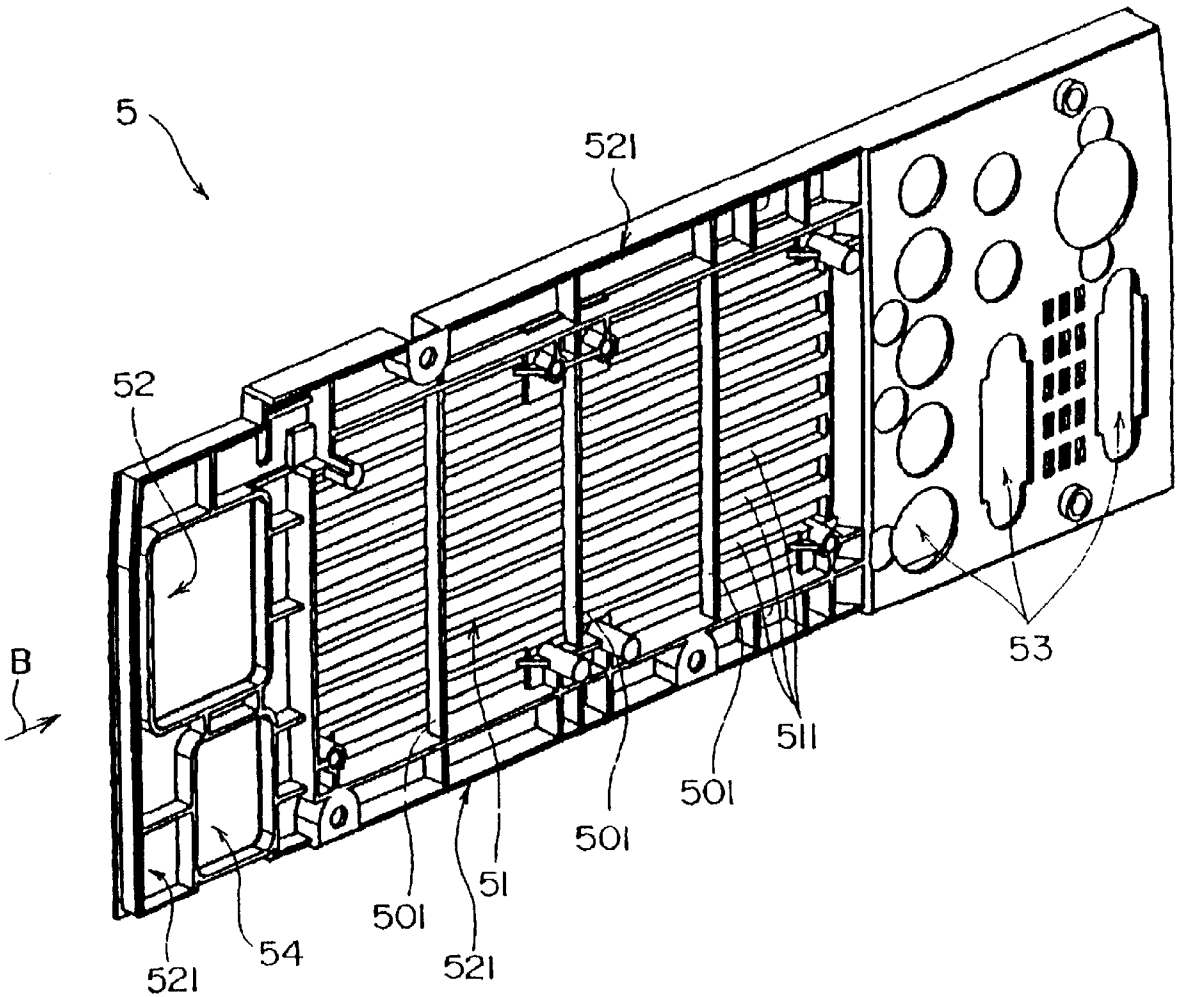
FIG. 15 is an overall perspective view showing an internal structure of the rear housing of the projection display apparatus according to the first embodiment.

Furthermore, as shown in FIG. 15, in the inside of the rear housing 5, supporting ribs 501 are formed. They are formed such that they cross over the grooved openings 511 which form the exhaust 51. In addition, a peripheral frame 521 is formed such that it surrounds a reference surface where the exhaust 51 is formed.

Hereinbelow, a description will be given of flow of the semimolten metal in formation of the upper housing 3, the lower housing 4, and the rear housing 5 described above.

The semimolten metal in a stirred state is fed from the apparatus rear-end side of a mold for the upper housing 3, that is, in the direction indicated by an arrow A in FIG. 11. The semimolten metal then flows onto the reference surface 301, the convex sections 302 and 303, and the ribs 306. As already described, the flow time is proportionally related to the wall thickness, therefore, velocity of flow through the convex sections 302 and 303 and the ribs 306 with thick walls is higher than in the case of the reference surface 301.

The semimolten metal flowing over the convex sections 302 and 303 diffuses around the reference surface 301, and one part thereof diffuses at an intersection with the supporting rib 304 in the direction perpendicular to a semimolten-metal flow direction B and then flows on the reference surface 301 at a downstream side of the supporting rib 304. Another part of the semimolten metal flowing over the convex section 302 flows toward the supporting rib 308 surrounding the switch button openings 32, fills out the area so as to surround the switch button openings 32, and then flows inside thereof to fill out the vicinity of the switch button openings 32. On the other hand, the semimolten metal flowing through the ribs 306 diffuses around the reference surface 301 so as to feed to the protrusions 305. In the area of the protrusions 305, the semimolten metal is guided by the flowing ribs 307 to fill out.

For the lower housing 4, in the same manner as in the case of the upper housing 3, the semimolten metal is fed from the apparatus rear-end side of a mold (in the direction indicated by an arrow A in FIG. 12). As shown in FIG. 13, at the air-intake 43, the semimolten metal fed then flows through the ribs 404, diffusing through borders of the long openings 431 which are perpendicular to the semimolten-metal flow direction so as to be filled therein.

Furthermore, as shown in FIG. 13(B) which is a cross-sectional view taken along line XIII—XIII in FIG. 13(A), the semimolten metal is induced by the comer R, which is arranged in the flowing sides of the roots of the ribs 401, so as to reach the rib edge. The comer R also induces the flow to a rib in the opposite direction.

When the semimolten metal flowing over the reference surface 402 reaches an intersection with the step surface 44, it is guided by the bevel section 403 so as to quickly flow through the step surface 44. A description regarding flow of the semimolten metal in other areas is omitted, since it is similar to the case of the upper housing 3 already described.

For the rear housing 5, as shown in FIG. 15, the semimolten metal is fed from a portion where the input/output-terminal connection opening 53 is formed toward the AC inlet connection opening 52 (as indicated by an arrow B). The semimolten metal then fills around the input/output-terminal connection opening 53 and flows through the exhaust 51. At the exhaust 51, the semimolten metal flows through the peripheral frame 521 of the rear housing 5, diffuses at intersections with the supporting ribs 501, and flows through borders of the grooved openings 511 which are parallel to the semimolten-metal flow direction so as to be filled therein.

In the above case, the wall thickness of the peripheral frame 521 is arranged to be greater than those of the portions in which there are formed the exhaust 51 (which is the reference surface), the AC inlet connection opening 52, the input/output-terminal connection opening 53, and the opening 54. By this arrangement, flow of the semimolten metal toward the input/output-terminal connection opening 53 is preceded, and flow around the grooved openings 511 is expedited through the supporting ribs 307. Of course, ribs are formed on a boss arranged with the exhaust 51 for induction of flow of the semimolten metal, and the boss is connected to the reference surface portion and the supporting ribs 501 of the exhaust 51 through the foregoing ribs.

According to the above embodiment, advantages as described below are provided.

Since the bevel section 403 is arranged on the step surface 44 of the lower housing 4, when the semimolten metal reaches the intersection of the reference surface 402 and the step surface 44, the semimolten metal is guided by the bevel section 403 so as to quickly flow through the step surface 44. Accordingly, in molding the lower housing 4 and in the flow of the semimolten metal to the forming mold, turbulent flow can be avoided, and fluid resistance can be reduced so as to reduce time for filling the semimolten metal.

Furthermore, since the convex sections 302 and 303 are arranged on the reference surface 301 of the upper housing 3, the semimolten metal is allowed to flow quickly along the convex sections 302 and 303. This reduces time for filling the semimolten metal into the forming mold in forming the upper housing 3. In addition, defects such as corrugates, blow holes, and dimples can be avoided by laminating the flow of the semimolten metal and averaging the velocity of the flow.

Furthermore, since the supporting rib 304 intersecting with the convex sections 302 and 303 is formed, the semimolten metal flowing through the convex sections 302 and 303 diffuses at the intersections of the supporting rib 304 and flows there. This further reduces time for filling the semimolten metal in forming the upper housing 3.

Furthermore, since the ribs 401 are formed such as that they individually surround the cover-installation opening 41 and the lamp-removing/fitting opening 42 of the lower housing 4, the time for filling the semimolten metal into peripheries of these openings can be reduced. In addition, these ribs 401 after they are formed reinforce the peripheries of these openings, increasing strength of the lower housing 4.

Furthermore, the ribs 404 are formed at the borders dividing the individual long openings 431 that compose the air-intake 43 reinforce the air-intake 43 entirely, allowing the strength of the lower housing 4 to be increased. Similarly, the supporting ribs 501 of the rear housing 5 serve to reduce time for filling the semimolten metal into the exhaust 51 and also to increase the strength of the exhaust 51.

Furthermore, since the flowing ribs 307 are formed on inflow sides of the protrusions 305, the semimolten metal is thereby guided quickly to the protrusion portions through the flowing ribs 307, allowing filling time to be reduced.

For the rear housing 5, molding can be implemented by the supporting ribs 501 for the boss arranged in a form having the plurality of grooved openings 511 of a small thickness and in the inside of the grooved openings 511, and concurrently, appearance and strength of the rear housing 5 can be improved by increasing the thickness of the peripheral frame 521.

Hereinbelow, a description will be given of a second embodiment according to the present invention with reference to the drawings.

Figure 16:
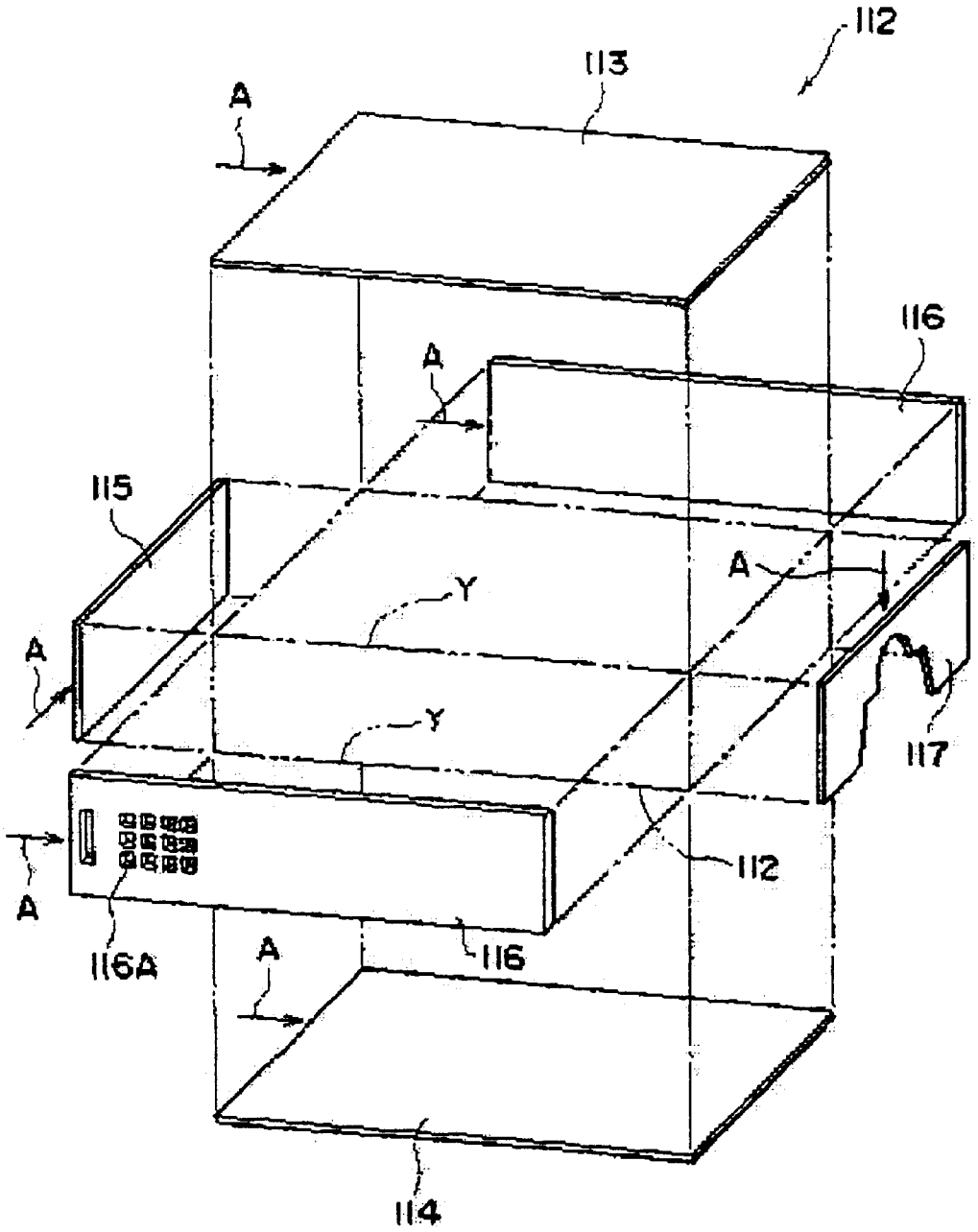
FIG. 16 is an overall perspective view showing an exploded structure of an outer housing of a projection display apparatus according to a second embodiment of the present invention.

As shown in FIG. 16, this embodiment has an outer housing 112 of a structure that is different from the outer housing 2 of the first embodiment described above. Arrangements of parts other than those relevant to the outer housing are similar to those of the first embodiment.

The outer housing 112 is formed in a hexahedron including an upper housing 113 covering the upper face of the apparatus, a lower housing 114 covering the bottom face of the apparatus, a pair of side housings 116 connecting the upper housing 113 and the lower housing 114 together and covering side faces of the apparatus, a rear housing 115 covering a reverse face of the apparatus, and a front housing 117 covering a front face of the apparatus. All these housings, such as the upper housing 113, are formed substantially to have plate-like planar faces. Furthermore, these housings 113 to 116 are independently formed to have substantially the same area as a plain section of the outer housing 112 indicated in virtual lines, which is surrounded by individual edge lines Ys. Furthermore, the individual housings such as the housing 113 are formed of a magnesium alloy.

The housings 113 to 116 are individually formed by a thixotropic forming method such as that described in the first embodiment.

A semimolten metal in a stirred state is fed from the apparatus rear end side (in the direction indicated by an arrow A in FIG. 16) of a mold to be used for forming the individual housings 113 to 116. The semimolten metal then flows onto entire plate-like faces to be filled therein.

Connection of the individual housings 113 to 116 together can be implemented, for example, by laser-beam seamless welding. When the individual housings 113 to 116 are connected together by such welding, engaged sections are preferably formed so as to be inconspicuous. Examples of forms and positions of engaged sections formed to be inconspicuous are described below with reference to FIGS. 17 to 19.

Figure 17:
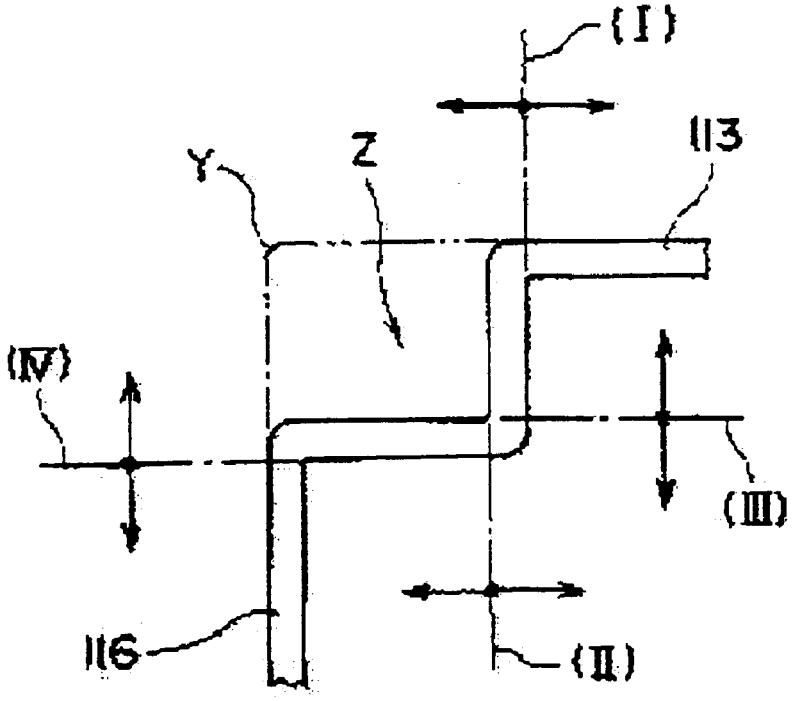
FIG. 17 is a view showing a engaged state of the outer housing of the projection display apparatus according to the second embodiment.

In FIG. 17, an edge-line section Y of the upper housing 113 and the slide housing 116 is made to be convex toward the inside substantially at the same size in the horizontal and vertical directions with a convex section Z. In this case, either one of (I) and (II) in the horizontal direction may be a engaged section (separation face). Alternatively, either one of (III) and (IV) in the vertical direction may be a engaged section.

Figure 18:
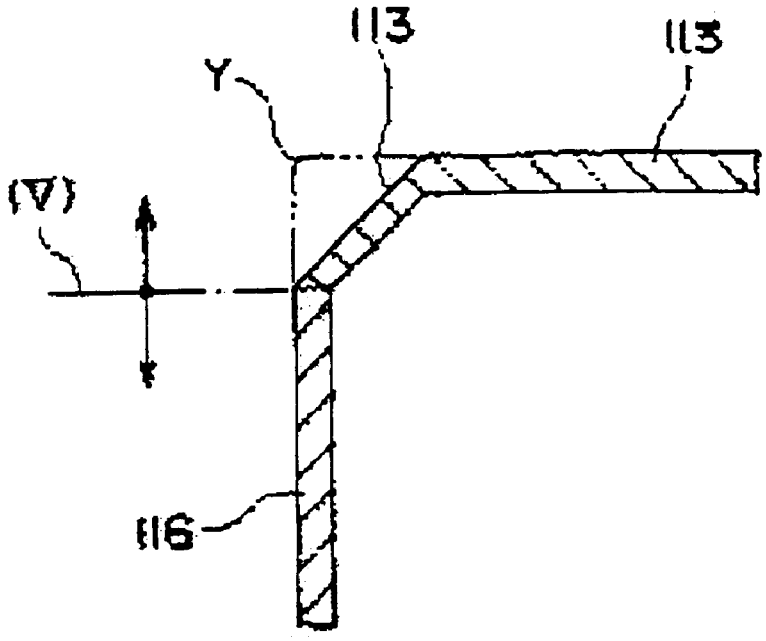
FIG. 18 is a view showing another engaged state of the outer housing of the projection display apparatus according to the second embodiment.
Figure 19:
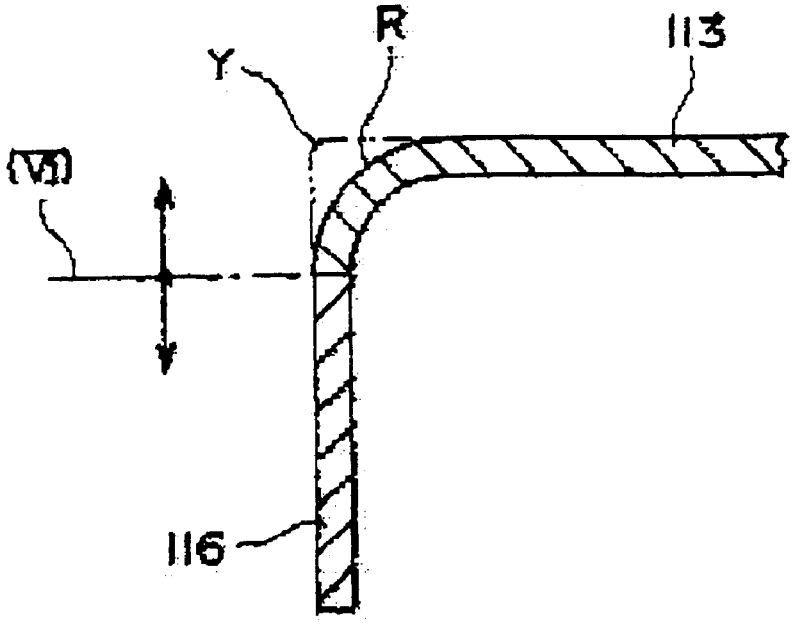
FIG. 19 is a view showing still another engaged state of the outer housing of the projection display apparatus according to the second embodiment.

In FIG. 18, an edge-line section Y of the upper housing 113 and the side housing 116 is a bevel section 113A, the lower end is a engaged section (V). In FIG. 19, an edge-line section Y of the upper housing 113 and the side housings 116 is a curved face R, and the lower end of this curved face R is a engaged section (VI).

In this way, these individual FIGS. 17 to 19 show the engaged section of the upper housing 113 and the side housings 116, however, other engaged sections can be arranged in the forms similar to the foregoing. Furthermore, the convex section Z, the bevel section 113A, or the curved face R of the edge lines shown in FIG. 17 to 19 not only makes the engaged section to be inconspicuous, but also makes the outer housing 112 to look thinner, improves it in terms of safety and strength, and provides appearance variation so as to be further esthetically pleasing.

The aforementioned second embodiment has the following advantages.

All the upper housing 113, the lower housing 114, the rear housing 115, and the side housings 116 of the outer housing 112 are formed substantially to have platelike planar faces. This allows smooth flow of the semimolten metal, reducing time for filling the semimolten metal.

Furthermore, for example, to arrange openings 116A in the side housings 116 as ventilation holes and the like when the upper housing and the side housings are integrally formed, slide cores must be used. In this embodiment, however, since the side housing 116 is formed of a plate-like member, such slide cores are not necessary.

Figure 20:
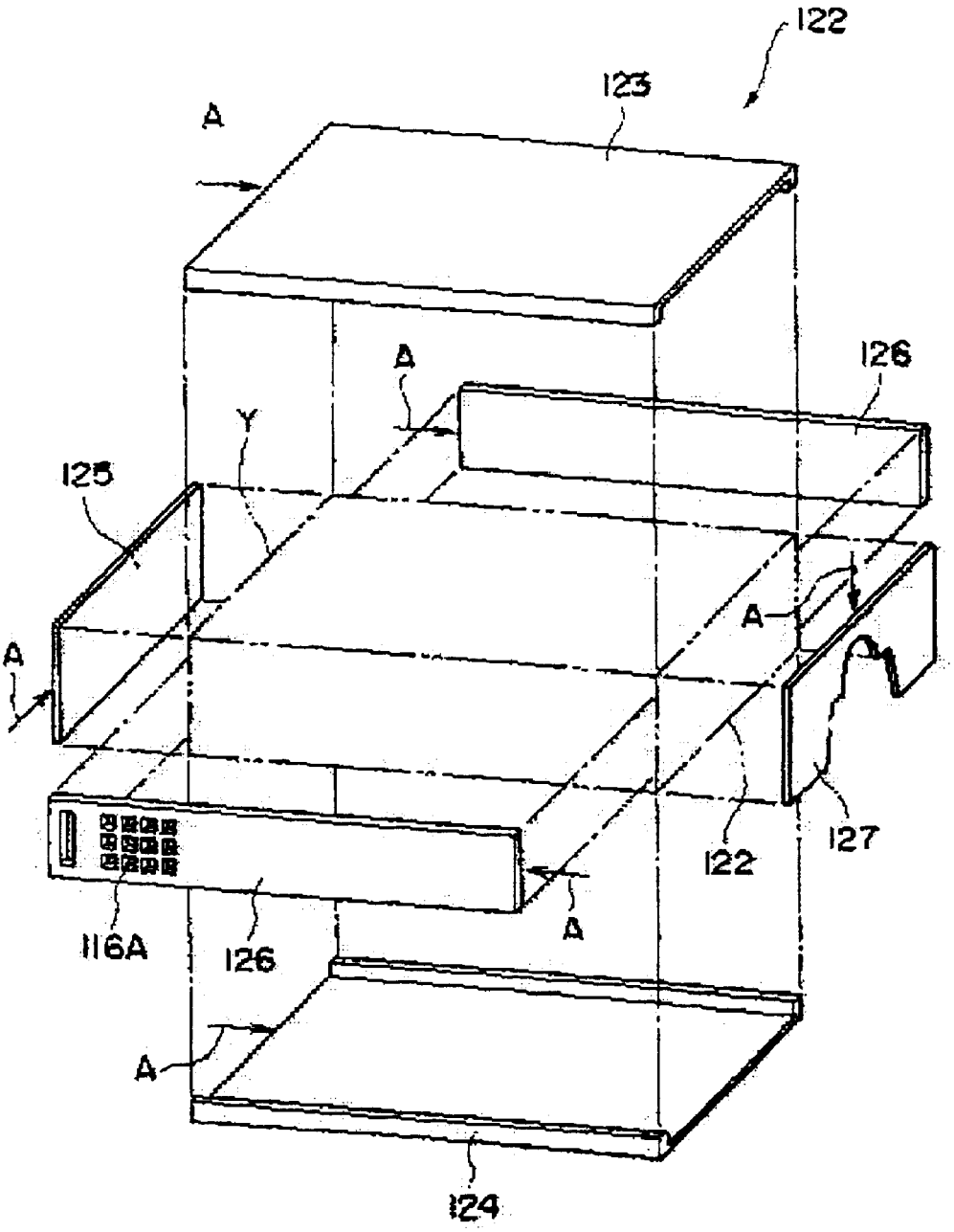
FIG. 20 is an overall perspective view showing an exploded structure of an outer housing of a projection display apparatus according to an embodiment of the present invention.

In the second embodiment, the outer housing 112 is separated into the six housings 113 to 116, but it may be separated such as in FIG. 20.

An outer housing 122 in FIG. 20 is separated into housings to cover faces of an apparatus to be formed thereby, as follows: an upper housing 123 to cover an upper and side-upper faces of the apparatus, a lower housing 124 to cover the bottom faces and lower side faces of the apparatus, a pair of side housings 126 to cover side faces between the foregoing housings 123 and 124 which are not covered by the foregoing housings 123 and 124, a rear housing 125 to cover the reverse face of the apparatus, and a front housing 127 to cover the front face of the apparatus. The upper housing 123 and the lower housing 124 are individually formed such that they are bent along edge lines linking the rear housing 125 and the front housing 127 by a predetermined width in the directions opposing each other. In a similar manner to that in the second embodiment, the housings 123 to 127 are independently formed by the thixotropic forming method. The semimolten metal in molding is fed from the direction indicated by an arrow A in FIG. 20.

This embodiment also has advantages similar to those of the second embodiment.

Figure 21:
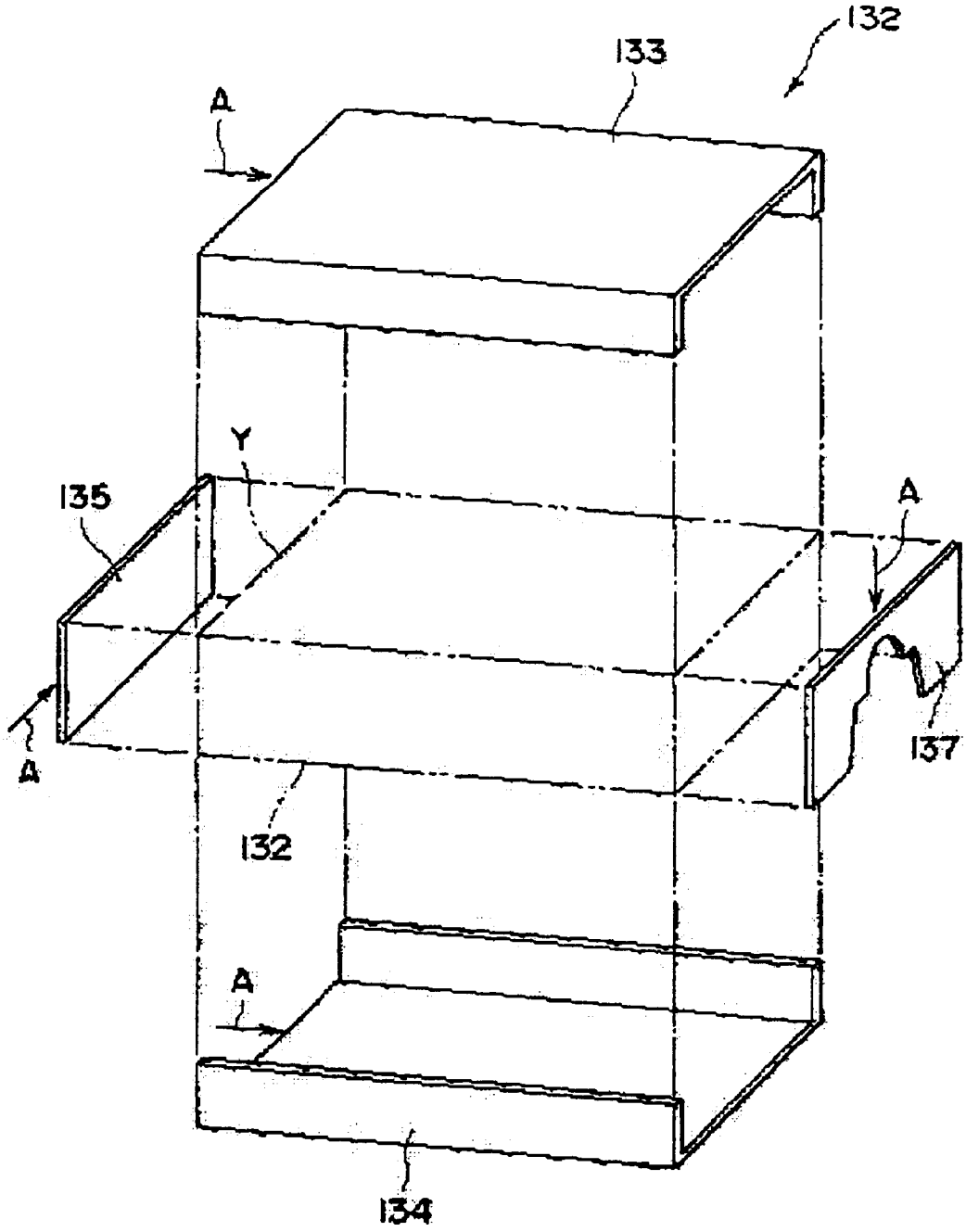
FIG. 21 is an overall perspective view showing an exploded structure of an outer housing of a projection display apparatus according to an embodiment of the present invention.

In the second embodiment, the outer housing 112 is separated into six housings 113 to 116, but may be separated such as that in FIG. 21.

An outer housing 132 in FIG. 21 is separated into housings to cover faces of an apparatus to be formed thereby, as follows: a U-shaped upper housing 133 to cover an upper and side-upper faces of the apparatus, a U-shaped lower housing 134 to cover the bottom faces and lower side faces of the apparatus, a rear housing 135 to cover the reverse face of the apparatus, and a front housing 137 to cover the front face of the apparatus. In a manner similar to that in the second embodiment, the housings 133, 134, 135, and 137 are independently formed by the thixotropic forming method. The semimolten metal in molding is fed from the direction indicated by arrow A in FIG. 21.

This embodiment also has advantages similar to those of the second embodiment in which the semimolten metal flows more smoothly so as to reduce the time for filling the semimolten metal. Furthermore, this embodiment uses a smaller number of components than in the case of the second embodiment, hence it is more advantageous in terms of the number of manufacturing steps and manufacturing costs.

It will be understood that the present invention is not restricted to preferred embodiments and modification examples thereof such as those described above, but also includes modifications as described hereinbelow.

(1) In the first embodiment, the bevel section 403 on the step surface 44 is formed on part of the step surface 44. The present invention is not limited to this. That is, the entire step surface may be beveled down or curved down in the direction where the semimolten metal flows. This also provides the same advantages as in the case of the aforementioned embodiment.

(2) In the first embodiment, the supporting ribs 307 are formed in a triangular state, but they may be formed such that an edge line between the reference surface and the protrusion is circular. This also provides the same advantages as in the case of the first embodiment.

(3) In the aforementioned embodiment, the magnesium alloy is used as a material for the housings, such as the upper housings 3 and 113, the lower housings 4 and 114, the rear housings 5 and 115, the side housings 116 and 126, and the front housing 117. However, any metal material, such as an aluminum or zinc alloy, which is suitable for the thixotropic forming method may be used as the material so as to provide the same advantages as in the individual embodiments described above.

(4) The present invention is applied for forming housings such as the outer housings 2 and 112 of the projection display apparatus 1. However, the present invention may also be applied for forming outer housings for different types of image display apparatuses.

In application of the present invention, structural and formative arrangements for practical items may be varied within a range where the objects of the present invention can be achieved.

As described above, according to the image display apparatus of the present invention, various considerations for improvement are implemented so that the semimolten metal can be filled in more quickly into molds and little defects cause in the appearance of the article formed when the thin articles are formed by use of the thixotropic forming method while simultaneously increasing the articles' strength.

What is claimed is:

1. An image display apparatus having an outer housing formed of metal in a thixotropic forming method, the outer housing comprising:

a reference surface formed along a direction in which semimolten metal flows in forming processing; and a step surface formed so as to face toward a downstream side of the semimolten-metal flow direction and so as to intersect with the reference surface, the step surface including a bevel section beveled down at least on a part thereof in the semimolten-metal flow direction.

2. The image display apparatus according to claim 1, the bevel section being formed entirely on the step surface.

3. The image display apparatus according to claim 1, the bevel section being formed by bevel-cutting a section where the reference surface and the step surface intersect each other.

4. The image display apparatus according to claim 1, the thickness of a section of the reference surface of the outer housing being 3.0 mm or less.

5. The image display apparatus according to claim 4, the thickness of the section of the reference surface of the outer housing being 1.5 mm or less.

6. The image display apparatus according to claim 1, the reference surface including convex sections extending in the direction in which the semimolten metal flows.

7. The image display apparatus according to claim 6, the reference surface further comprising a supporting rib formed so as to intersect with the convex sections and so as to protrude from the reference surface.

8. The image display apparatus according to claim 7, the reference surface including at least one opening, and the supporting rib being formed along an internal periphery of the opening.

9. The image display apparatus according to claim 8, the reference surface including a plurality of openings orderly arranged along the semimolten-metal flow direction, and the supporting rib being formed along a border dividing the openings adjacent to each other.

10. An image display apparatus according to claim 9, the outer housing comprising a peripheral frame formed so as to surround the reference surface and so as to have a thickness greater than the thickness of the reference surface, and the supporting rib being arranged so as to connect with the peripheral frame.

11. The image display apparatus according to claim 1, the outer housing further comprising protrusions formed so as to protrude from the reference surface, the protrusions including flowing ribs at inflow sides thereof for guiding the semimolten metal thereinto.

12. An image display apparatus having an outer housing formed of metal in a thixotropic forming method, the outer housing comprising a reference surface formed along a direction in which semimolten metal flows in forming processing, the reference surface comprising convex sections extending in the direction in which the semimolten metal flows.

13. The image display apparatus according to claim 12, the reference surface further comprising a supporting rib formed so as to intersect with the convex sections and so as to protrude from the reference surface.

14. The image display apparatus according to claim 13, the reference surface including at least one opening, and the supporting rib being formed along an internal periphery of the opening.

15. The image display apparatus according to claim 14, the reference surface including a plurality of openings orderly arranged along the semimolten-metal flow direction, and the supporting rib being formed along a border dividing the openings adjacent to each other.

16. An image display apparatus according to claim 15, the outer housing comprising a peripheral frame formed so as to surround the reference surface and so as to have a thickness greater than the thickness of the reference surface, and the supporting rib being arranged so as to connect with the peripheral frame.

17. The image display apparatus according to claim 12, the thickness of a section of the reference surface of the outer housing being 3.0 mm or less.

18. The image display apparatus according to claim 17, the thickness of the section of the reference surface of the outer housing being 1.5 mm or less.

19. The image display apparatus according to claim 12, the outer housing further comprising protrusions formed so as to protrude from the reference surface, the protrusions including flowing ribs at inflow sides thereof for guiding the semimolten metal thereinto.

20. The image display apparatus according to claim 19, the outer housing further comprising a step surface formed so as to face toward a downstream side of the semimolten-metal flow direction and so as to intersect with the reference surface, the step surface including a bevel section beveled down at least on a part thereof in the semimolten-metal flow direction.

21. An image display apparatus having an outer housing formed of metal in a thixotropic forming method, the outer housing comprising:

a reference surface formed along a direction in which semimolten metal flows in forming processing; and protrusions formed so as to protrude from the reference surface, the protrusions including flowing ribs at inflow sides thereof for guiding the semimolten metal thereinto.

22. The image display apparatus according to claim 21, the thickness of a section of the reference surface of the outer housing being 3.0 mm or less.

23. The image display apparatus according to claim 22, the thickness of the section of the reference surface of the outer housing being 1.5 mm or less.

* * * * *